US008500231B2

(12) United States Patent
Nishihara

(10) Patent No.: US 8,500,231 B2
(45) Date of Patent: Aug. 6, 2013

(54) INKJET RECORDING DEVICE AND CONTROLLER, CONTROL PROGRAM AND CONTROL METHOD FOR INKJET RECORDING DEVICE FOR GAP REDUCTION OF INK DROPLETS

(75) Inventor: Masahiro Nishihara, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 0 days.

(21) Appl. No.: 13/353,456

(22) Filed: Jan. 19, 2012

(65) Prior Publication Data

US 2012/0113173 A1 May 10, 2012

Related U.S. Application Data

(62) Division of application No. 11/659,831, filed as application No. PCT/JP2005/011757 on Jun. 27, 2005, now Pat. No. 8,113,615.

(30) Foreign Application Priority Data

Aug. 10, 2004 (JP) ..... 2004-232908
Aug. 31, 2004 (JP) ..... 2004-253608

(51) Int. Cl.
*B41J 29/38* (2006.01)

(52) U.S. Cl.
USPC ..... 347/14; 347/15

(58) Field of Classification Search
USPC ..... 347/14, 15
See application file for complete search history.

(56) References Cited

U.S. PATENT DOCUMENTS

| | | | |
|---|---|---|---|
| 5,733,623 | A | 3/1998 | Raychaudhuri et al. |
| 6,264,298 | B1 | 7/2001 | Mantell |
| 6,375,294 | B1 | 4/2002 | Kneezel |
| 6,466,335 | B1 | 10/2002 | Umezawa et al. |
| 7,222,929 | B2 | 5/2007 | Silverbrook |
| 7,275,801 | B2 | 10/2007 | Chiwata |
| 7,438,375 | B2 | 10/2008 | Arazaki |
| 7,520,583 | B2 | 4/2009 | Arazaki et al. |

(Continued)

FOREIGN PATENT DOCUMENTS

| | | |
|---|---|---|
| EP | 0962324 | 12/1999 |
| EP | 1277588 | 1/2001 |

(Continued)

OTHER PUBLICATIONS

Search Report for corresponding European Patent Application No. 11185814.8, dated Apr. 17, 2012.

(Continued)

*Primary Examiner* — Laura Martin
(74) *Attorney, Agent, or Firm* — Banner & Witcoff, Ltd.

(57) ABSTRACT

Aspects of the disclosure relate to a controller, control program, and control method for an inkjet recording device, and an inkjet recording device capable of forming a high-quality image by making positional shift of a landing ink droplet inconspicuous through simple control. A high-quality image can be formed by controlling nozzles ejecting an ink droplet landing at a position where the pitch of adjacent landing droplets is larger than a predetermined pitch such that the area of a landing droplet formed by the nozzles is larger, thereby reducing the gap between landing droplet trains by the landing droplet train for ink droplets corresponding to print data.

8 Claims, 18 Drawing Sheets

U.S. PATENT DOCUMENTS

| | | | | |
|---|---|---|---|---|
| 2003/0016268 | A1 | 1/2003 | Hickman et al. | |
| 2003/0122890 | A1* | 7/2003 | Shimada et al. | 347/19 |
| 2004/0032438 | A1* | 2/2004 | Silverbrook | 347/12 |
| 2004/0095421 | A1 | 5/2004 | Hickman et al. | |
| 2006/0125852 | A1 | 6/2006 | Yamakado | |
| 2006/0139389 | A1 | 6/2006 | Sakai | |

FOREIGN PATENT DOCUMENTS

| | | |
|---|---|---|
| EP | 1405727 | 4/2004 |
| JP | 10-15382 | 1/1989 |
| JP | 2-192955 | 7/1990 |
| JP | 10-119437 | 5/1998 |
| JP | 10-235854 | 9/1998 |
| JP | 11-215363 | 8/1999 |
| JP | 11-309857 | 11/1999 |
| JP | 2000-326497 | 11/2000 |
| JP | 2002-240287 | 8/2002 |
| JP | 2003-118098 | 4/2003 |

OTHER PUBLICATIONS

Office Action mailed Oct. 26, 2010 for corresponding Japanese Patent Application No. 2004-253608.

Decision of Rejection mailed Oct. 26, 2010 in corresponding Japanese Patent Application No. 2004-232908.

Office Action mailed Aug. 3, 2010 for corresponding Japanese Patent Application No. 2004-253608.

Office Action mailed Aug. 3, 2010 for corresponding Japanese Patent Application No. 2004-232908.

European Search Report mailed Mar. 17, 2010 in corresponding EP Application No. 05753328.

English translation of International Preliminary Report dated Feb. 22, 2007 in App. No. PCT/JP2005/011757.

* cited by examiner

FIG.4(a)
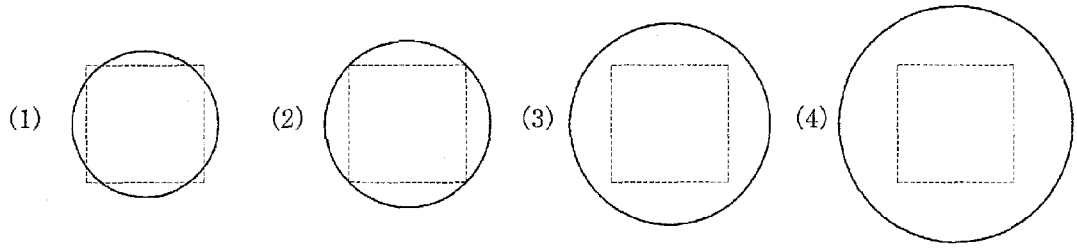
FIG.4(b)
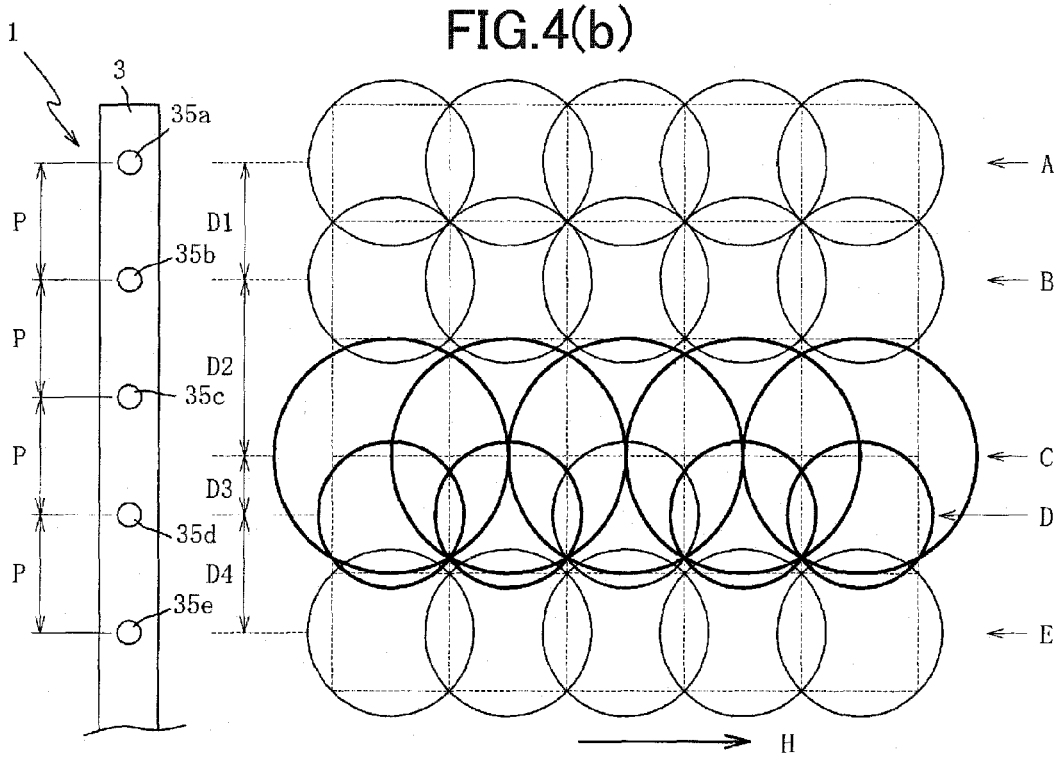
FIG.4(c)
47a
| NOZZLE POSITION | DOT LEVEL |
|---|---|
| 1 | 0 |
| 2 | 0 |
| 3 | +2 |
| 4 | −1 |
| 5 | 0 |
| ⋮ | ⋮ |

FIG.5(a)
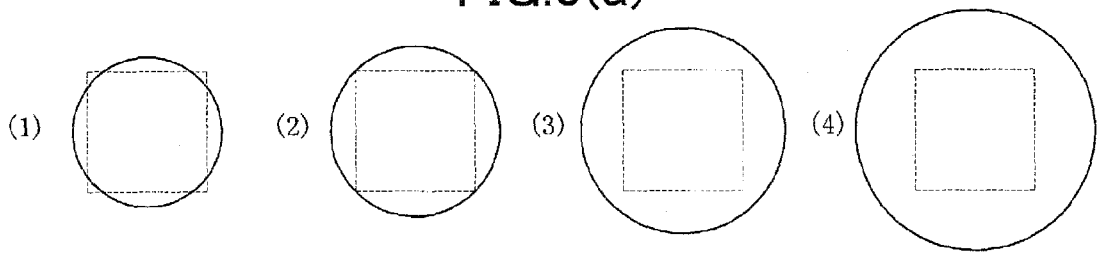
FIG.5(b)
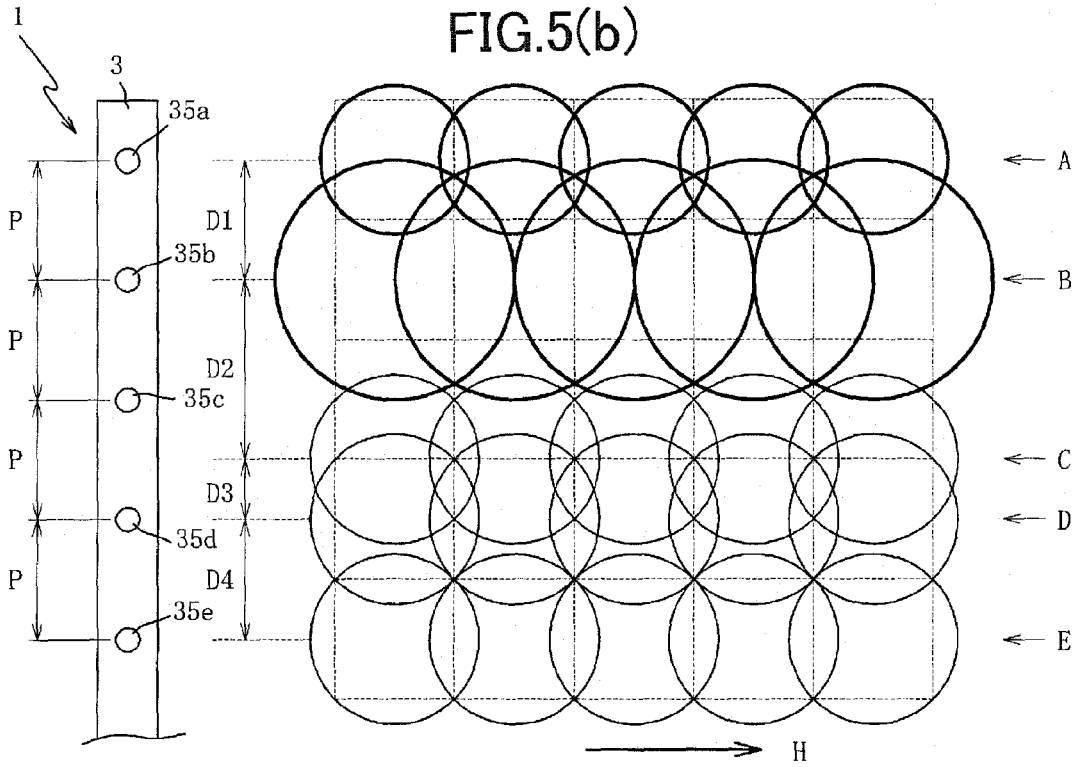
FIG.5(c)
47a
| NOZZLE POSITION | DOT LEVEL |
|---|---|
| 1 | −1 |
| 2 | +2 |
| 3 | 0 |
| 4 | 0 |
| 5 | 0 |
| ⋮ | ⋮ |

FIG.6(a)
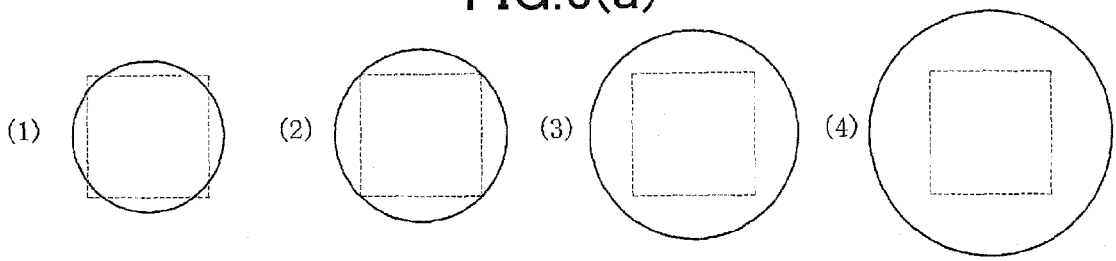
FIG.6(b)
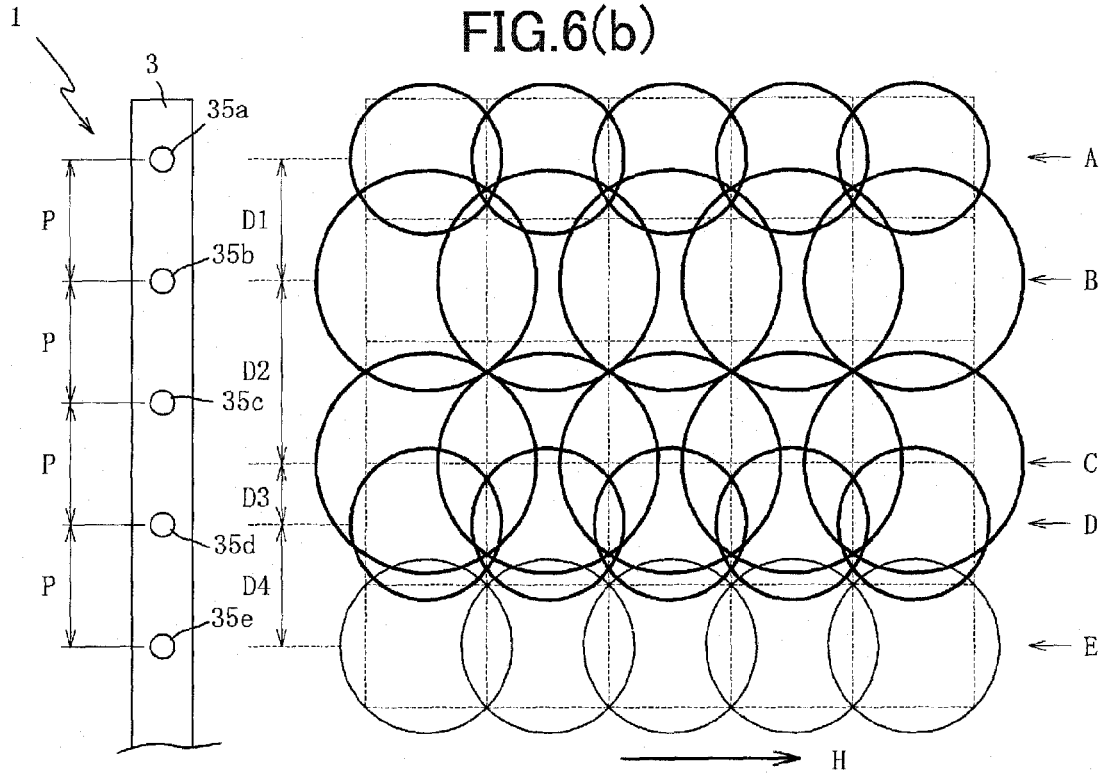
FIG.6(c)
47a
| NOZZLE POSITION | DOT LEVEL |
|---|---|
| 1 | −1 |
| 2 | +1 |
| 3 | +1 |
| 4 | −1 |
| 5 | 0 |
| ⋮ | ⋮ |

FIG.7(a)
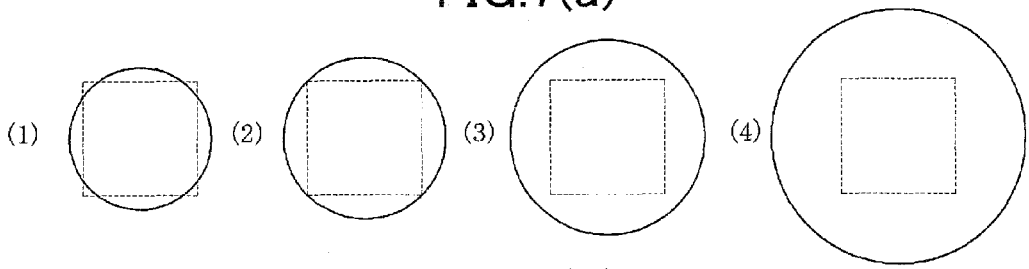
FIG.7(b)
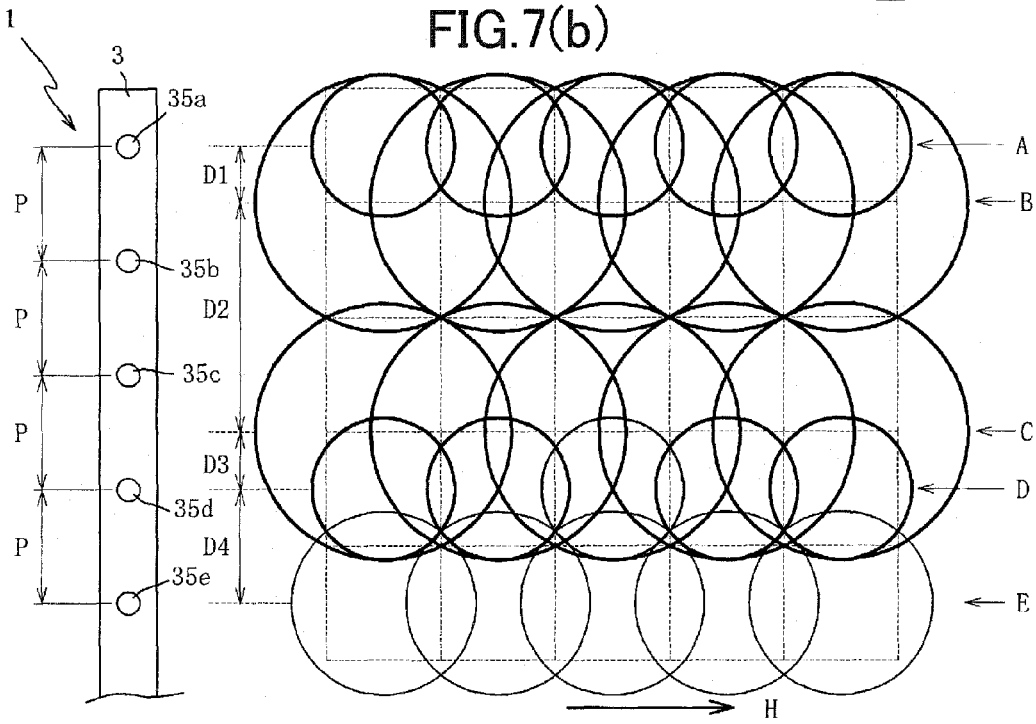
FIG.7(c)
47a
| NOZZLE POSITION | DOT LEVEL |
|---|---|
| 1 | −1 |
| 2 | +2 |
| 3 | +2 |
| 4 | −1 |
| 5 | 0 |
| ⋮ | ⋮ |

FIG.8(a)
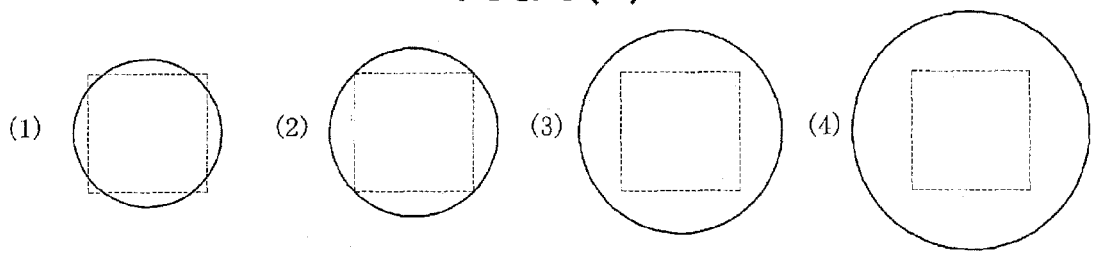
FIG.8(b)
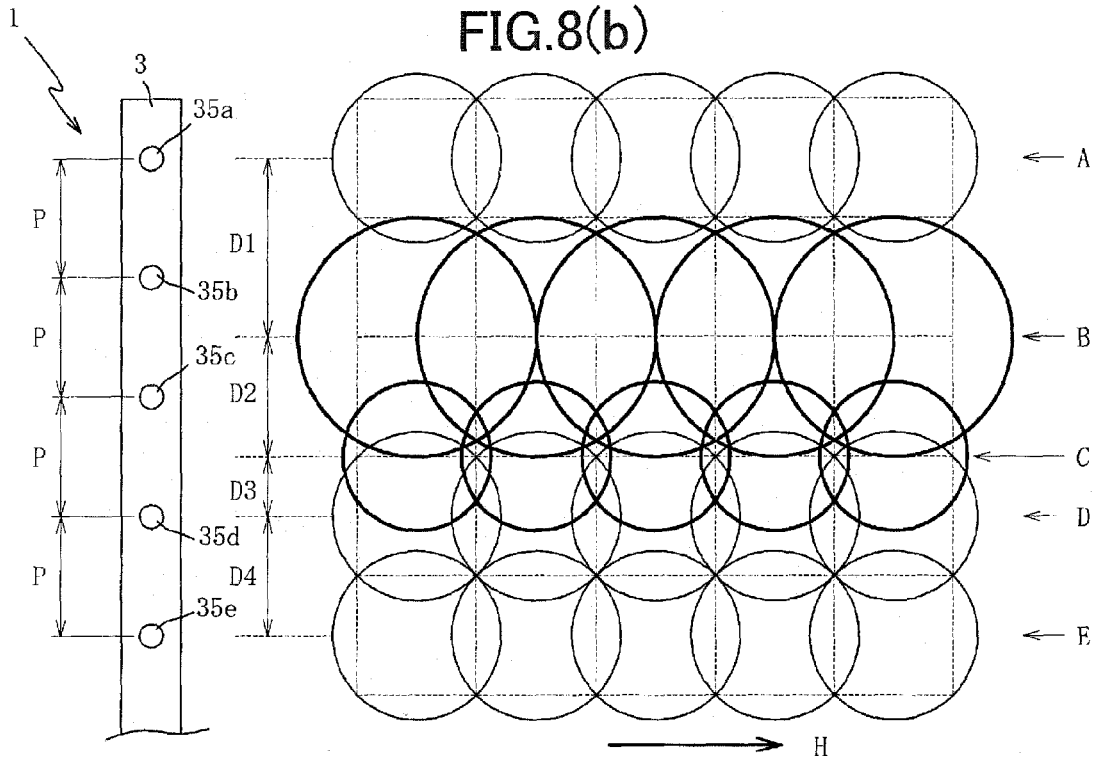
FIG.8(c)
47a
| NOZZLE POSITION | DOT LEVEL |
|---|---|
| 1 | 0 |
| 2 | +2 |
| 3 | −1 |
| 4 | 0 |
| 5 | 0 |
| ⋮ | ⋮ |

INKJET RECORDING DEVICE AND CONTROLLER, CONTROL PROGRAM AND CONTROL METHOD FOR INKJET RECORDING DEVICE FOR GAP REDUCTION OF INK DROPLETS

CROSS-REFERENCE TO RELATED APPLICATIONS

This application is a divisional of co-pending U.S. patent application Ser. No. 11/659,831, filed Dec. 21, 2007, which is a National Stage application of PCT application PCT/JP2005/011757, filed Jun. 27, 2005, which was published in Japanese under PCT Article 21(2) on Feb. 16, 2006, which is based upon and claims the benefit of Japanese Patent Application No. 2004-232908 filed Aug. 10, 2004, and Japanese Patent Application No. 2004-253608, filed Aug. 31, 2004. These applications are incorporated herein by reference in their entirety.

TECHNICAL FIELD

The present invention relates to a controller for an inkjet recording device, a control program for an inkjet recording device, a method of controlling an inkjet recording device, and an inkjet recording device capable of, through a simple control process, forming high-quality images having no noticeable deviations in dot positions.

BACKGROUND ART

Line-type inkjet recording devices well known in the art are equipped with a line head having nozzles arranged over the maximum printing width of a printing medium. In this line-type inkjet recording device, the line head can remain fixed while the printing medium is conveyed a prescribed distance after the line head prints each line. Hence, this line-type inkjet recording device has the advantage of being able to print faster than serial-type inkjet printing devices that print while reciprocating a print head.

Next, a description will be given with reference to FIG. 1 on the arrangement of nozzles in this conventional line-type inkjet recording device and the relationship of these nozzles to the dots formed on a printing medium by ink droplets ejected from the nozzles. FIG. 1(*a*) illustrates the ideal relationship between the nozzles and dots formed on the printing medium for the conventional line-type inkjet recording device.

As shown in FIG. 1(*a*), a line head 101 has five nozzles 102*a*-102*e* arranged linearly (in the left-to-right direction in FIG. 1) at a prescribed pitch P. Here, the nozzles 102*a*-102*e* are actually not arranged along the same line but are each disposed in one of a plurality of lines in the line head. In other words, FIG. 1 shows the nozzles 102*a*-102*e* that eject ink droplets for forming dots within the same line as being themselves arranged in the same line.

Further, the nozzles 102*a*-102*e* eject ink droplets toward a printing medium (not shown) as the printing medium is conveyed in a conveying direction H (downward in FIG. 1) to a position opposite the line head 101. The ink droplets ejected from the nozzles 102*a*-102*e* impact the printing medium and form dots of a size sufficient to circumscribe square pixels (indicated by dotted lines in FIG. 1(*a*)).

Hence, when these five nozzles 102*a*-102*e* eject ink droplets vertically toward the printing medium, the ink droplets impact the printing medium to form five overlapping dots arranged in a straight line (the left-to-right direction in FIG. 1) at a prescribed pitch D.

By repeating the operation described above at a prescribed timing while conveying the printing medium, ink droplets ejected from the nozzle 102*a* form a column of dots A arranged vertically in FIG. 1. Similarly, the nozzles 102*b*, 102*c*, 102*d*, and 102*e* produce columns of dots B, C, D, and E having no gaps therebetween.

Although the ejected ink droplets are expected to follow a vertical trajectory toward the printing medium, ink droplets are sometimes ejected along a slanted trajectory relative to the printing medium due to various reasons, such as dust, solidified ink globules, and the like obstructing one of the nozzles 102*a*-102*e* or ink deposited around the periphery of the nozzle pulling against the ejected ink droplet.

FIG. 1(*b*) shows the relationship between the nozzles and dots formed by ink droplets ejected from the nozzles when ink droplets ejected from the nozzle 102*c* follow a slanted trajectory relative to the printing medium due to one of the reasons described above.

As shown in FIG. 1(*b*) when the nozzle 102*c* ejects ink droplets at a slant to the printing medium (toward the nozzle 102*d*), the ink droplets form a column of dots C having a bias toward the column of dots D so that a pitch D2 between the columns of dots B and C is greater than the prescribed pitch. Consequently, a gap is produced between the columns of dots B and C that appears as a streak along the conveying direction H of the printing medium, lowering the quality of the image.

To resolve this problem, Patent Reference 1 given below discloses an inkjet printer comprising means for vibrating the line head 101 described above. By vibrating the line head 101 with the head vibrating means of this technology, ink droplets ejected from the nozzles also vibrate in response, decreasing the gap described above and thereby preventing a drop in image quality.

Another technique for resolving the problem described above is disclosed in Patent Reference 2 given below. In this technology, a plurality of heaters capable of being driven independently of one another is provided for a single nozzle, the heaters being provided at different positions in an ink chamber corresponding to the nozzle. This technology changes the heater being driven and the driving force of the heater for each line. Hence, this technology can vary the positions at which the ink droplets impact the printing medium, thereby reducing the gap described above and preventing a drop in image quality.

Patent Reference 1: Japanese unexamined patent application publication No. HEI-10-235854 (paragraph 18, FIG. 2, etc.)

Patent Reference 2: Japanese unexamined patent application publication No. 2002-240287 (paragraph 52, etc.)

Problems to be Solved by the Invention

However, by requiring the head vibrating means for vibrating the line head, the technology disclosed in Patent Reference 1 leads to a larger device and an increase in manufacturing costs.

Further, by requiring a plurality of independently driven heaters for each nozzle, the technology disclosed in Patent Reference 2 increases the complexity and cost of the manufacturing process and requires a complex control process for individually controlling the heaters.

To resolve the problems described above, it is an object of the present invention to provide a controller for an inkjet recording device, a control program for an inkjet recording device, a method of controlling an inkjet recording device, and an inkjet recording device capable of forming high-quality images with no noticeable deviations in dot positions through a simple control process.

Means for Solving the Problems

To solve the problems described above, the present invention provides a controller for controlling an inkjet recording device, the inkjet recording device having nozzles through which ink droplets are ejected toward a printing medium, by outputting instructions to the inkjet recording device to eject ink droplets so that the size of dots formed when the ejected ink droplets impact the printing medium is a prescribed size based on print data, the controller comprising ejection instructing means for outputting instructions to the inkjet recording device in order that the size of dots formed by ink droplets ejected from a first nozzle is greater than a prescribed size corresponding to print data, the first nozzle being at least one of two nozzles ejecting ink droplets that impact positions to form neighboring dots with a pitch greater than a prescribed pitch.

The controller having this construction outputs instructions to the inkjet recording device in order that the size of dots formed by ink droplets ejected from the first nozzle of two nozzles ejecting ink droplets that impact positions forming neighboring dots with a pitch greater than a prescribed pitch is greater than the prescribed size in the print data.

When neighboring dots are formed at positions having a greater pitch than the prescribed pitch, a gap is formed between the neighboring dots having the prescribed size indicated in the print data. However, the present invention can reduce this gap by outputting instructions to the inkjet recording device to eject ink droplets for forming dots corresponding to the first nozzle of a size greater than the prescribed size indicated in the print data. Therefore, the inkjet recording device can form high-quality images with no noticeable gaps produced by deviations in dot positions.

With the controller described above, the ejection instructing means outputs instructions in order that the size of dots formed by ink droplets ejected from the first nozzle increases as the pitch of neighboring dots increases.

The controller having this construction instructs the inkjet recording device to increase the size of dots formed by ink droplets ejected by the first nozzle as the pitch of neighboring dots increases. Accordingly, the controller can control the inkjet recording device to eject ink droplets for forming dots of a size capable of reducing a gap produced between neighboring dots based on the size of the gap produced when forming dots of a prescribed size indicated in the print data. Therefore, the inkjet recording device can form high-quality images without noticeable gaps, even when error in dot positions produces large gaps.

With the controller described above, the first nozzle is a nozzle whose ejected ink droplets impact the printing medium at an incorrect position among two nozzles ejecting ink droplets that impact positions to form neighboring dots with a pitch greater than a prescribed pitch.

With the controller having this construction, the first nozzle ejects ink droplets that impact the printing medium at incorrect positions among two nozzles that eject ink droplets forming neighboring dots with a pitch greater than the prescribed pitch. Accordingly, the controller can perform a simple control process to eject ink droplets from the first nozzle that form dots of a size larger than the prescribed size indicated in the print data.

With the controller described above, the first nozzle is a nozzle other than the nozzle whose ejected ink droplets impact the printing medium at an incorrect position among two nozzles ejecting ink droplets that impact positions to form neighboring dots with a pitch greater than a prescribed pitch.

With the controller having this construction, the first nozzle is a nozzle other than the nozzle whose ejected ink droplets impact the printing medium at an incorrect position among two nozzles ejecting ink droplets that impact positions to form neighboring dots with a pitch greater than the prescribed pitch. Accordingly, the controller can reduce the amount of overlap between a dot corresponding to the first nozzle and dots corresponding to nozzles on both sides of the first nozzle compared to the controller described above that sets the first nozzle as the nozzle whose ejected ink droplets impact the printing medium at incorrect positions. Therefore, the controller can reduce the overlapping portions that have a high density in order to form high-quality images with a more uniform density.

With the controller described above, the ejection instructing means outputs instructions to the inkjet recording device to eject ink droplets from a second nozzle for forming dots of a smaller size than the prescribed size in the print data, the second nozzle being one of two nozzles positioned on either side of the first nozzle whose ejected ink droplets form dots at a smaller pitch with dots formed by the ejected ink droplets from the first nozzle.

The controller having this construction can control the inkjet recording device to eject ink droplets from a second nozzle for forming dots of a smaller size than the prescribed size in the print data, the second nozzle being one of two nozzles positioned on either side of the first nozzle whose ejected ink droplets form dots at a smaller pitch with dots formed by the ejected ink droplets from the first nozzle.

Hence, since the second nozzle forms dots of a smaller size, the controller can reduce the amount of overlap between dots corresponding to the first nozzle and dots corresponding to the second nozzle, even when the size of dots formed by the first nozzle has been increased. Therefore, the controller can reduce the overlapping area having a high density in order to form high-quality images with a more uniform density.

With the controller described above, the first nozzle includes two nozzles that eject ink droplets forming neighboring dots having a larger pitch than a prescribed pitch.

With the controller having this construction, since the first nozzle includes two nozzles that eject ink droplets forming neighboring dots with a larger pitch than a prescribed pitch, the controller can reduce the size of dots produced by the first nozzle required to fill a gap of the same size better than the controller described above that sets the first nozzle as one of two nozzles. Therefore, this controller can form high-quality images having less graininess.

Further, since this controller can reduce the size of dots produced by the first nozzle, the overlapping area between dots corresponding to the first nozzle and dots corresponding to nozzles neighboring the first nozzle can be reduced more than with the controller described above that sets the first nozzle to one of two nozzles. Therefore, this controller can reduce the overlapping area that has a high density in order to form high-quality images with a more uniform density.

With the controller described above, the ejection instructing means outputs instructions to the inkjet recording device for ejecting ink droplets from two second nozzles to form dots of a size smaller than the prescribed size in the print data, the two second nozzles being positioned one on either side of the two first nozzles.

The controller having this construction can control the inkjet recording device to eject ink droplets from two second nozzles to form dots of a size smaller than the prescribed size in the print data, the two second nozzles being positioned one on either side of the two first nozzles.

Hence, since this controller can reduce the size of dots produced by the second nozzles, it is possible to reduce the overlapping area between dots produced by the first nozzles and dots produced by the second nozzles, even when increasing the size of dots corresponding to the first nozzles. Accordingly, the controller can reduce the overlapping area that has a high density in order to form high-quality images with a more uniform density.

The controller described above further comprises storing means for storing at least one of a first parameter specifying instructions for forming dots with ink droplets ejected from the nozzles larger than the prescribed size in the print data, and a second parameter specifying instructions for forming dots with ink droplets ejected from the nozzles smaller than the prescribed size in the print data; wherein the ejection instructing means outputs instructions to the inkjet recording device based on the parameters stored in the storing means.

With the controller having this construction, the ejection instructing means outputs instructions to the inkjet recording device based on the parameters stored in the storing means. Accordingly, control of the ejection instruction means can be simplified simply by ejecting ink based on parameters stored in the storing means.

With the controller described above, the parameters stored in the storing means can be rewritten.

Since the parameters stored in the storing means can be rewritten, the controller having this construction can modify the first and second parameters based on the circumstances. In other words, by modifying the first and second parameters, it is possible to modify the size of dots corresponding to the first and second nozzles.

For example, while initially it may be possible to fill a gap by setting the first parameter to produce dots from the first nozzle 1.2 times the size of the prescribed size indicated in the print data, other gaps may be formed later due to some factor. When this occurs, the gap can be reduced by modifying the first parameter to increase the size of dots produced by the first nozzle to 1.4 times the prescribed size, thereby forming images of a high quality over a long period.

With the controller described above, the storing means can store the first parameter and/or the second parameter for each nozzle.

Since the first parameter and/or second parameter can be newly stored for each nozzle, excluding the first nozzle, if a nozzle whose ink droplets originally impacted the correct position later ejects ink droplets that impact incorrect positions due to some factor, the controller having this construction can reduce the gap produced by dots formed at the incorrect positions by setting the first parameter and/or second parameter for this nozzle and neighboring nozzles, thereby forming images of a high quality over a long period.

With the controller described above, the ejection instructing means outputs instructions to the inkjet recording device via an interface of the inkjet recording device when the inkjet recording device forms images on a printing medium based on data received from an external device.

With the controller having this construction, the ejection instructing means outputs instructions to the inkjet recording device via an interface of the inkjet recording device when the inkjet recording device forms images on a printing medium based on data received from an external device. Therefore, the controller can control an inkjet recording device of this type without being installed on the inkjet recording device. Hence, it is possible to form high-quality images using this type of inkjet recording device without adversely affecting the structure or manufacturing costs of the inkjet recording device itself.

With the controller described above, the ejection instructing means outputs instructions to the inkjet recording device via an interface of the inkjet recording device when the inkjet recording device has a line head for forming images on a printing medium by moving in a single direction relative to the printing medium.

With the controller having this construction, the ejection instructing means outputs instructions to the inkjet recording device via an interface of the inkjet recording device when the inkjet recording device has a line head for forming images on a printing medium by moving in a single direction relative to the printing medium. Hence, this type of inkjet recording device can be controlled without installing the controller on the device. Accordingly, it is possible to form high-quality images using this type of inkjet recording device without adversely affecting the structure or manufacturing costs of the inkjet recording device itself.

With the controller described above, the ejection instructing means outputs instructions to the inkjet recording device for ejecting ink drops of a plurality of sizes based on print data, and outputs instructions to the inkjet recording device for ejecting ink droplets from a third nozzle different from the first nozzle and the second nozzle of a size based on the print data.

With the controller having this construction, the ejection instructing means outputs instructions to the inkjet recording device for ejecting ink droplets from a third nozzle of a size based on the print data. Accordingly, the ink droplets ejected from the third nozzle are of a size based on the print data, thereby forming images according to the dot size indicated in the print data.

To solve the problems described above, the present invention provides a controller for controlling an inkjet recording device, the inkjet recording device having a plurality of nozzles aligned in a first direction orthogonal to a relative movement direction that are moved in a single direction relative to a printing medium to form images thereon, by outputting instructions to the inkjet recording device to eject ink droplets from nozzles toward the printing medium so that the ink droplets impacting the printing medium form dots at prescribed positions corresponding to the print data, the controller comprising outputting means for outputting instructions to the inkjet recording device in order that every $n^{th}$ column among columns of dots extending in the relative movement direction is shifted in the relative movement direction.

The controller having this construction outputs instructions to the inkjet recording device in order that every $n^{th}$ column among columns of dots extending in the relative movement direction is shifted in the relative movement direction. Accordingly, the controller can reduce gaps produced between neighboring dots in the first direction better than the method of outputting instructions to the inkjet recording device for aligning dots in the relative movement direction, even when some factor causes the dots to shift in the first direction orthogonal to the relative movement direction. Therefore, it is possible to form high-quality images without noticeable gaps produced due to deviations in dot positions.

With the controller described above, the outputting means outputs instructions to the inkjet recording device for shifting the dots in the relative movement direction by about half the pitch of dots aligned in the relative movement direction.

The controller having this construction outputs instructions to the inkjet recording device for shifting the dots in the relative movement direction by about half the pitch of dots aligned in the relative movement direction. Accordingly, the controller can reduce gaps produced between neighboring dots in the first direction with the greatest efficiency when some factor causes dots to deviate in the first direction orthogonal to the relative movement direction.

The controller described above further comprises converting means for converting a layout of pixels in the print data to a layout in which every prescribed $n^{th}$ column of pixels arranged in the relative movement direction is shifted in the relative movement direction; wherein the outputting means outputs instructions to the inkjet recording device to form dots based on the layout of pixels converted by the converting means.

The controller having this construction outputs instructions to the inkjet recording device to form dots based on the layout of pixels converted to a layout in which every prescribed $n^{th}$ n column of pixels arranged in the relative movement direction is shifted in the relative movement direction, thereby adjusting dot positions through simple control.

With the controller described above, the outputting means outputs instructions to the inkjet recording device in order that the nozzles forming dots shifted in the relative movement direction eject an additional ink droplet for one pixel on an end of the shifted column opposite the shifting direction when the print data is data for printing a line shape in a first direction.

The controller having this construction outputs instructions to the inkjet recording device in order that the nozzles forming dots shifted in the relative movement direction eject an additional ink droplet for one pixel on an end of the shifted column opposite the shifting direction when the print data is data for printing a line shape in a first direction. Therefore, suppressing distortion in images caused when printing line shapes based on print data by shifting every prescribed $n^{th}$ columns of dots arranged in the relative movement direction in the relative movement direction.

With the controller described above, the outputting means outputs instructions to the inkjet recording device in order that the nozzles forming dots shifted in the relative movement direction form dots at both ends of each shifted column with respect to the relative movement direction at a density less than the density of dots corresponding to the print data when the print data is data for printing a line shape in the first direction.

The controller having this construction outputs instructions to the inkjet recording device in order that the nozzles forming dots shifted in the relative movement direction form dots at both ends of each shifted column with respect to the relative movement direction at a density less than the density of dots corresponding to the print data when the print data is data for printing a line shape in the first direction. Accordingly, the controller can further suppress distortion in images produced by shifting every $n^{th}$ columns of dots extending in the relative movement direction in the relative movement direction when printing line shapes according to the print data.

The controller described above further comprises data creating means for creating additional data to print an additional pixel worth on an end of each column of pixels shifted in the relative movement direction opposite the shifted direction when the print data is data for printing a line shape in the first direction; and pixel value setting means for setting a pixel value for pixels on each end of shifted columns of pixels to a value less than the pixel value in the print data when pixel values defining the dot density are set for each pixel and when the print data is data for printing a line shape in the first direction; wherein the outputting means outputs instructions to the inkjet recording device regarding the dot density according to pixel values set by the pixel value setting means.

The controller having this construction creates additional data to print an additional pixel worth on an end of each column of pixels shifted in the relative movement direction opposite the shifted direction, sets a pixel value for pixels on each end of shifted columns of pixels to a value less than the pixel value in the print data, and outputs instructions to the inkjet recording device regarding the dot density based on the set pixel values, when the print data is data for printing a line shape in the first direction, thereby adjusting the positions and densities of dots through a simple control process.

With the controller described above, the pixel value setting means distributes part of a pixel value for shifted pixels to the pixel value of a pixel added to an end of each shifted column opposite the shifted direction so that the pixel value of the added pixel is set to the distributed pixel value when the print data is data for printing a line shape in the first direction.

The controller having this construction distributes part of a pixel value for shifted pixels to the pixel value of a pixel added to an end of each shifted column opposite the shifted direction so that the pixel value of the added pixel is set to the distributed pixel value when the print data is data for printing a line shape in the first direction. Accordingly, the controller can set pixel values at both ends of each shifted column to a value less than the value indicated in the print data through a simple control process.

With the controller described above, the ratio of the distributed pixel value is set based on the ratio of a shift amount of the shifted pixels to a length on one side of each pixel.

With the controller having this construction, the ratio of the distributed pixel value is set based on the ratio of the shift amount of shifted pixels to a length on one side of each pixel, thereby setting the density of pixels based on the shift amount. Accordingly, the controller can suppress distortion in an image based on the shift amount.

With the controller described above, the outputting means outputs instructions to the inkjet recording device via an interface of the inkjet recording device when the inkjet recording device forms images on a printing medium based on data received from an external device.

With the controller having this construction, the outputting means outputs instructions to the inkjet recording device via an interface of the inkjet recording device when the inkjet recording device forms images on a printing medium based on data received from an external device. Therefore, the controller can control an inkjet recording device in which the controller is not installed. Accordingly, it is possible to form high-quality images using an inkjet recording device, without adversely affecting the structure and manufacturing costs of the inkjet recording device itself.

To solve the problems described above, the present invention provides a controller for controlling an inkjet recording device, the inkjet recording device having a plurality of nozzles arranged in a first direction orthogonal to a relative movement direction for forming images through movement in a single direction relative to the printing medium, by outputting instructions to the inkjet recording device to eject ink droplets from the nozzles toward the printing medium so that the ink droplets impacting the printing medium form dots at prescribed positions based on the print data, the controller comprising outputting means for outputting instructions to the inkjet recording device so that neighboring dots in the relative movement direction orthogonal to the first direction have a smaller pitch than neighboring dots in the first direction throughout a printing area on the printing medium.

The controller having this construction outputs instructions to the inkjet recording device so that neighboring dots in the relative movement direction have a smaller pitch than neighboring dots in the first direction. Accordingly, gaps are less likely to form between neighboring dots in the relative movement direction when some factor causes the dots aligned in the relative movement direction to shift in the first direction than when the pitch of neighboring dots in the relative movement direction is set the same as the pitch of neighboring dots in the first direction. Therefore, it is possible to form high-quality images without noticeable gaps caused by deviations in dot positions.

With the controller described above, the outputting means outputs instructions to the inkjet recording device to form more dots in the relative movement direction than the number of dots prescribed in the print data based on a pitch of dots in the relative movement direction that is smaller than the pitch of neighboring dots in the first direction.

The controller having this construction outputs instructions to the inkjet recording device to form more dots in the relative movement direction than the number of dots prescribed in the print data based on a pitch of dots in the relative movement direction that is smaller than the pitch of neighboring dots in the first direction. Accordingly, the controller can set the ratio of the image size in the relative movement direction and the first direction to be approximately the same as that when the pitch of dots is identical in the relative movement direction and first direction, even when setting the pitch of dots in the relative movement direction less than that of dots in the first direction. Therefore, it is possible to form high-quality images by suppressing distortion in the images.

With the controller described above, the outputting means outputs instructions to the inkjet recording device for shifting in the relative movement direction every prescribed $n^{th}$ column of dots aligned in the relative movement direction.

The controller having this construction outputs instructions to the inkjet recording device for shifting in the relative movement direction every prescribed $n^{th}$ column of dots aligned in the relative movement direction. Therefore, the controller can reduce gaps produced between neighboring dots in the first direction better than a method of outputting instructions to the inkjet recording device for aligning dots in the relative movement direction, even if some factor causes the dots to be shifted in the first direction orthogonal to the relative movement direction. Accordingly, it is possible to form high-quality images without noticeable gaps caused by deviations in dot positions.

With the controller described above, the outputting means outputs instructions to the inkjet recording device through an interface of the inkjet recording device when the inkjet recording device forms images on a printing medium based on data received from an external device.

With the controller having this construction, the outputting means outputs instructions to the inkjet recording device via an interface of the inkjet recording device when the inkjet recording device forms images on a printing medium based on data received from an external device. Accordingly, the controller can control an inkjet recording device in which the controller is not installed, thereby forming high-quality images with the inkjet recording device, without adversely affecting the structure and manufacturing costs of the inkjet recording device itself.

To solve the problems described above, the present invention provides a controller for controlling an inkjet recording device, the inkjet recording device having a plurality of nozzles arranged in a first direction orthogonal to a relative movement direction for forming images through movement in a single direction relative to a printing medium, by outputting instructions to the inkjet recording device to eject ink droplets from the nozzles toward the printing medium so that the ejected ink droplets form dots on the printing medium at prescribed positions specified in print data, the controller comprising outputting means for outputting instructions to the inkjet recording device in order that dots formed by ink droplets ejected from a first nozzle are shifted in the relative movement direction, the first nozzle being at least one of two nozzles ejecting ink droplets that impact positions to form neighboring dots in the first direction with a pitch greater than a prescribed pitch.

The controller having this construction outputs instructions to the inkjet recording device in order that dots formed by ink droplets ejected from a first nozzle are shifted in the relative movement direction, the first nozzle being at least one of two nozzles ejecting ink droplets that impact positions to form neighboring dots in the first direction with a pitch greater than the prescribed pitch. Accordingly, the controller can reduce gaps produced between neighboring dots by setting the pitch of neighboring dots in the first direction greater than the prescribed pitch. Hence, it is possible to form high-quality images without noticeable gaps produced by deviations in dot positions.

With the controller described above, the outputting means outputs instructions to the inkjet recording device through an interface of the inkjet recording device when the inkjet recording device forms images on a printing medium based on data received from an external device.

With the controller having this construction, the outputting means outputs instructions to the inkjet recording device via an interface of the inkjet recording device when the inkjet recording device forms images on the printing medium based on data received from an external device. Therefore, the controller can control an inkjet recording device in which the controller is not installed. Accordingly, it is possible to form high-quality images using the inkjet recording device, without adversely affecting the structure and manufacturing costs of the inkjet recording device itself.

To solve the problems described above, the present invention provides a recording medium for recording in a format readable by a computer a control program that controls an inkjet recording device having nozzles through which ink droplets are ejected toward a printing medium by outputting instructions to the inkjet recording device to eject ink droplets so that the size of dots formed when the ejected ink droplets impact the printing medium is a prescribed size based on print data, the control program comprising an ejection instructing step for outputting instructions to the inkjet recording device in order that the size of dots formed by ink droplets ejected from a first nozzle is greater than a prescribed size corresponding to print data, the first nozzle being at least one of two nozzles ejecting ink droplets that impact positions to form neighboring dots with a pitch greater than a prescribed pitch.

The computer program having this construction outputs instructions to the inkjet recording device in order that the size of dots formed by ink droplets ejected from the first nozzle of two nozzles ejecting ink droplets that impact positions forming neighboring dots with a pitch greater than a prescribed pitch is greater than the prescribed size in the print data.

When neighboring dots are formed at positions having a greater pitch than the prescribed pitch, a gap is formed between the neighboring dots having the prescribed size indicated in the print data. However, the present invention can reduce this gap by outputting instructions to the inkjet recording device to eject ink droplets for forming dots corresponding to the first nozzle of a size greater than the prescribed size indicated in the print data. Therefore, the inkjet recording device can form high-quality images with no noticeable gaps produced by deviations in dot positions.

To solve the problems described above, the present invention provides a recording medium for recording in a format readable by a computer a control program that controls an inkjet recording device having a plurality of nozzles aligned in a first direction orthogonal to a relative movement direction and moved in a single direction relative to a printing medium to form images thereon by outputting instructions to the inkjet recording device to eject ink droplets from nozzles toward the printing medium so that the ink droplets impacting the printing medium form dots at prescribed positions corresponding to the print data, the control program comprising an outputting step for outputting instructions to the inkjet recording device in order that every $n^{th}$ column among columns of dots extending in the relative movement direction is shifted in the relative movement direction.

The control program having this construction outputs instructions to the inkjet recording device in order that every $n^{th}$ column among columns of dots extending in the relative movement direction is shifted in the relative movement direction. Accordingly, the control program can reduce gaps produced between neighboring dots in the first direction better than the method of outputting instructions to the inkjet recording device for aligning dots in the relative movement direction, even when some factor causes the dots to shift in the first direction orthogonal to the relative movement direction. Therefore, it is possible to form high-quality images without noticeable gaps produced due to deviations in dot positions.

To solve the problems described above, the present invention provides a recording medium for recording in a format readable by a computer a control program that controls an inkjet recording device having a plurality of nozzles arranged in a first direction orthogonal to a relative movement direction for forming images through movement in a single direction relative to the printing medium, by outputting instructions to the inkjet recording device to eject ink droplets from the nozzles toward the printing medium so that the ink droplets impacting the printing medium form dots at prescribed positions based on the print data, the control program comprising an outputting step for outputting instructions to the inkjet recording device so that neighboring dots in the relative movement direction orthogonal to the first direction have a smaller pitch than a pitch of neighboring dots in the first direction throughout a printing area on the printing medium.

The control program having this construction outputs instructions to the inkjet recording device so that neighboring dots in the relative movement direction have a smaller pitch than neighboring dots in the first direction. Accordingly, gaps are less likely to form between neighboring dots in the relative movement direction when some factor causes the dots aligned in the relative movement direction to shift in the first direction than when the pitch of neighboring dots in the relative movement direction is set the same as the pitch of neighboring dots in the first direction. Therefore, it is possible to form high-quality images without noticeable gaps caused by deviations in dot positions.

To solve the problems described above, the present invention provides a recording medium for recording in a format readable by a computer a control program that controls an inkjet recording device having a plurality of nozzles arranged in a first direction orthogonal to a relative movement direction for forming images through movement in a single direction relative to a printing medium by outputting instructions to the inkjet recording device to eject ink droplets from the nozzles toward the printing medium so that the ejected ink droplets form dots on the printing medium at prescribed positions specified in print data, the control program comprising an outputting step for outputting instructions to the inkjet recording device in order that dots formed by ink droplets ejected from a first nozzle are shifted in the relative movement direction, the first nozzle being at least one of two nozzles ejecting ink droplets that impact positions to form neighboring dots in the first direction with a pitch greater than a prescribed pitch.

The control program having this construction outputs instructions to the inkjet recording device in order that dots formed by ink droplets ejected from a first nozzle are shifted in the relative movement direction, the first nozzle being at least one of two nozzles ejecting ink droplets that impact positions to form neighboring dots in the first direction with a pitch greater than the prescribed pitch. Accordingly, the control program can reduce gaps produced between neighboring dots by setting the pitch of neighboring dots in the first direction greater than the prescribed pitch. Hence, it is possible to form high-quality images without noticeable gaps produced by deviations in dot positions.

To solve the problems described above, the present invention provides a method of controlling an inkjet recording device, the inkjet recording device having nozzles through which ink droplets are ejected toward a printing medium, by outputting instructions to the inkjet recording device to eject ink droplets so that the size of dots formed when the ejected ink droplets impact the printing medium is a prescribed size based on print data, the method comprising an ejection instructing step for outputting instructions to the inkjet recording device in order that the size of dots formed by ink droplets ejected from a first nozzle is greater than a prescribed size corresponding to print data, the first nozzle being at least one of two nozzles ejecting ink droplets that impact positions to form neighboring dots with a pitch greater than a prescribed pitch.

This control method is configured to output instructions to the inkjet recording device in order that the size of dots formed by ink droplets ejected from the first nozzle of two nozzles ejecting ink droplets that impact positions forming neighboring dots with a pitch greater than a prescribed pitch is greater than the prescribed size in the print data.

When neighboring dots are formed at positions having a greater pitch than the prescribed pitch, a gap is formed between the neighboring dots having the prescribed size indicated in the print data. However, the present invention can reduce this gap by outputting instructions to the inkjet recording device to eject ink droplets for forming dots corresponding to the first nozzle of a size greater than the prescribed size indicated in the print data. Therefore, the inkjet recording device can form high-quality images with no noticeable gaps produced by deviations in dot positions.

To solve the problems described above, the present invention provides a method of controlling an inkjet recording device, the inkjet recording device having a plurality of nozzles aligned in a first direction orthogonal to a relative movement direction that are moved in a single direction relative to a printing medium to form images thereon, by outputting instructions to the inkjet recording device to eject ink droplets from nozzles toward the printing medium so that the ink droplets impacting the printing medium form dots at prescribed positions corresponding to the print data, the method comprising an outputting step for outputting instructions to the inkjet recording device in order that every $n^{th}$ column among columns of dots extending in the relative movement direction is shifted in the relative movement direction.

This control method outputs instructions to the inkjet recording device in order that every $n^{th}$ column among columns of dots extending in the relative movement direction is shifted in the relative movement direction. Accordingly, the control method can reduce gaps produced between neighboring dots in the first direction better than the method of outputting instructions to the inkjet recording device for aligning dots in the relative movement direction, even when some factor causes the dots to shift in the first direction orthogonal to the relative movement direction. Therefore, it is possible to form high-quality images without noticeable gaps produced due to deviations in dot positions.

To solve the problems described above, the present invention provides a method of controlling an inkjet recording device, the inkjet recording device having a plurality of nozzles arranged in a first direction orthogonal to a relative movement direction for forming images through movement in a single direction relative to the printing medium, by outputting instructions to the inkjet recording device to eject ink droplets from the nozzles toward the printing medium so that the ink droplets impacting the printing medium form dots at prescribed positions based on the print data, the method comprising an outputting step for outputting instructions to the inkjet recording device so that neighboring dots in the relative movement direction orthogonal to the first direction have a smaller pitch than neighboring dots in the first direction throughout a printing area on the printing medium.

This control method outputs instructions to the inkjet recording device so that neighboring dots in the relative movement direction have a smaller pitch than neighboring dots in the first direction. Accordingly, gaps are less likely to form between neighboring dots in the relative movement direction when some factor causes the dots aligned in the relative movement direction to shift in the first direction than when the pitch of neighboring dots in the relative movement direction is set the same as the pitch of neighboring dots in the first direction. Therefore, it is possible to form high-quality images without noticeable gaps caused by deviations in dot positions.

To solve the problems described above, the present invention provides a method of controlling an inkjet recording device, the inkjet recording device having a plurality of nozzles arranged in a first direction orthogonal to a relative movement direction for forming images through movement in a single direction relative to a printing medium, by outputting instructions to the inkjet recording device to eject ink droplets from the nozzles toward the printing medium so that the ejected ink droplets form dots on the printing medium at prescribed positions specified in print data, the method comprising an outputting step for outputting instructions to the inkjet recording device in order that dots formed by ink droplets ejected from a first nozzle are shifted in the relative movement direction, the first nozzle being at least one of two nozzles ejecting ink droplets that impact positions to form neighboring dots in the first direction with a pitch greater than a prescribed pitch.

This control method outputs instructions to the inkjet recording device in order that dots formed by ink droplets ejected from a first nozzle are shifted in the relative movement direction, the first nozzle being at least one of two nozzles ejecting ink droplets that impact positions to form neighboring dots in the first direction with a pitch greater than the prescribed pitch. Accordingly, the control method can reduce gaps produced between neighboring dots by setting the pitch of neighboring dots in the first direction greater than the prescribed pitch. Hence, it is possible to form high-quality images without noticeable gaps produced by deviations in dot positions.

To solve the problems described above, one or more aspects of the present invention provides an inkjet recording device for ejecting ink droplets from nozzles toward a printing medium and forming images with dots formed when the ejected ink droplets impact the printing medium, the inkjet recording device comprising a controller for controlling the inkjet recording device.

Since the inkjet recording device having this construction is controlled by the controller, it is possible to achieve the same effects as described above.

The inkjet recording device described above further comprises a line head for forming images on a printing medium by moving in a single direction relative to the printing medium; and moving means for moving the line head in a single direction relative to the printing medium; the line head ejecting ink droplets from the nozzles while moving in a single direction relative to the printing medium to form images on the printing medium according to instructions from the ejection instructing means or in the ejection instruction step.

With the inkjet recording device having this construction, the line head ejects ink droplets from the nozzles while moving in a single direction relative to the printing medium to form images on the printing medium according to instructions from the ejection instructing means or in the ejection instructing step. Accordingly, the inkjet recording device can eject ink droplets at a faster speed and with more stability than when moving both the head and the printing medium, thereby forming high-quality images at a fast speed.

To solve the problems described above, one or more aspects of the present invention provides an inkjet recording device for ejecting ink droplets from nozzles toward a printing medium and forming images with dots formed when the ejected ink droplets impact the printing medium, the inkjet recording device comprising a control program for controlling the inkjet recording device.

The inkjet recording device described above further comprises a line head for forming images on a printing medium by moving in a single direction relative to the printing medium; and moving means for moving the line head in a single direction relative to the printing medium; the line head ejecting ink droplets from the nozzles while moving in a single direction relative to the printing medium to form images on the printing medium according to instructions from the ejection instructing means or in the ejection instruction step.

With the inkjet recording device having this construction, the line head ejects ink droplets from the nozzles while moving in a single direction relative to the printing medium to form images on the printing medium according to instructions from the ejection instructing means or in the ejection instructing step. Accordingly, the inkjet recording device can eject ink droplets at a faster speed and with more stability than when moving both the head and the printing medium, thereby forming high-quality images at a fast speed.

To solve the problems described above, the present invention provides an inkjet recording device comprising nozzles arranged in a first direction within a printing area of a printing medium for ejecting ink droplets, and a line head in which the nozzles are formed that moves relative to the printing medium in a second direction orthogonal to the first direction for forming an image on the printing medium, wherein the nozzles are arranged at a pitch in the first direction smaller than a pitch in the second direction of dots formed by ink droplets ejected from the nozzles impacting the printing medium.

With the inkjet recording device of this construction, the nozzles are arranged at a pitch in the first direction smaller than a pitch in the second direction of dots formed by ink droplets ejected from the nozzles impacting the printing medium. Accordingly, the inkjet recording device can produce dots in the first direction of a smaller pitch than the dots in the second direction.

Therefore, gaps are less likely to be formed between dots arranged in the first direction than in the method of setting the pitch for dots in the first direction identical to the pitch of dots in the second direction, even when some factor causes dots arranged in the first direction to shift in the first direction. Hence, it is possible to form high-quality images without noticeable gaps produced by deviations in dot positions.

The inkjet recording device described above further comprises outputting means for outputting instructions to eject ink droplets from the nozzles toward the printing medium so as to impact the printing medium at prescribed positions for forming dots corresponding to print data; the outputting means outputting instructions to form more dots in the first direction than the number indicated in the print data based on the pitch of nozzles in the first direction that is smaller than the pitch of neighboring dots in the second direction.

With the inkjet recording device having this construction, instructions are outputted to form more dots in the first direction than the number indicated in the print data based on the pitch of nozzles in the first direction that is smaller than the pitch of neighboring dots in the second direction. Therefore, this configuration can set the ratio of the image size in the first direction and second direction approximately the same as when the pitch of dots is identical in the first and second directions, even when the pitch of dots arranged in the first direction is less than that of dots arranged in the second direction.

BRIEF DESCRIPTION OF THE DRAWINGS

FIG. 1(*b*) illustrates the relationship between the nozzles and dots for the conventional inkjet recording device when some factor causes ink droplets ejected from a prescribed nozzle to follow a slanted trajectory relative to the printing medium.

FIG. 4 is related to a first embodiment, wherein FIG. 4(*a*) shows various sizes of dots (1)-(4) formed when ink droplets ejected from nozzles of the printer impact the printing medium; FIG. 4(*b*) illustrates relationships between the nozzles and dots formed by ink droplets ejected from these nozzles; and FIG. 4(*c*) shows a dot level table.

FIG. 5 is related to a second embodiment, wherein FIG. 5(*a*) shows various sizes of dots (1)-(4) formed when ink droplets ejected from nozzles of the printer impact the printing medium; FIG. 5(*b*) illustrates relationships between the nozzles and dots formed by ink droplets ejected from these nozzles; and FIG. 5(*c*) shows a dot level table.

FIG. 6 is related to a third embodiment, wherein FIG. 6(*a*) shows various sizes of dots (1)-(4) formed when ink droplets ejected from nozzles of the printer impact the printing medium; FIG. 6(*b*) illustrates relationships between the nozzles and dots formed by ink droplets ejected from these nozzles; and FIG. 6(*c*) shows a dot level table.

FIG. 7 is related to a fourth embodiment, wherein FIG. 7(*a*) shows various sizes of dots (1)-(4) formed when ink droplets ejected from nozzles of the printer impact the printing medium; FIG. 7(*b*) illustrates relationships between the nozzles and dots formed by ink droplets ejected from these nozzles; and FIG. 7(*c*) shows a dot level table.

FIG. 8 is related to a fifth embodiment, wherein FIG. 8(*a*) shows various sizes of dots (1)-(4) formed when ink droplets ejected from nozzles of the printer impact the printing medium; FIG. 8(*b*) illustrates relationships between the nozzles and dots formed by ink droplets ejected from these nozzles; and FIG. 8(*c*) shows a dot level table.

FIG. 9(*b*) shows the same relationship when some factor causes ink droplets ejected for forming the dots shown in FIG. 9(*a*) to follow a slanted trajectory.

FIGS. 10(*b*) and 10(*c*) show converted states of the pixel layout in FIG. 10(*a*). FIG. 10(*d*) show values set for each pixel in the pixel layout of FIG. 10(*c*) that have been separated according to color FIG. 11(*a*) shows the pixel layout based on the original print data. FIG. 11(*c*) shows pixel values set for each pixel in the layout of FIG. 11(*b*) that have been separated according to color.

FIG. 12(*b*) is a partially enlarged view of converted pixels illustrating the method of determining a distribution ratio.

FIG. 14(*b*) is related to an eighth embodiment and shows the relationship between the nozzles and dots formed by ink droplets ejected from the nozzles.

FIG. 15(*b*) shows the same relationship when some factor causes ink droplets for forming the dots shown in FIG. 15(*a*) to follow a slanted trajectory.

FIG. 16(*b*) shows the same relationship when some factor causes ink droplets for forming the dots shown in FIG. 16(*a*) to follow a slanted trajectory.

1 PC (controller for an inkjet recording device)

1A inkjet printer (inkjet recording device)

23 EEPROM (part of storing means)

45*a* ink ejection control program (ejection instruction means, control program for an inkjet recording device)

45*b* pixel layout conversion program (part of outputting means, converting means, data creating means)

45*c* pixel value distribution program (part of outputting means, pixel value setting means)

47 hard disk (part of storing means)

47*a* dot level table (part of storing means)

BEST MODE FOR CARRYING OUT THE INVENTION

Figure 2:
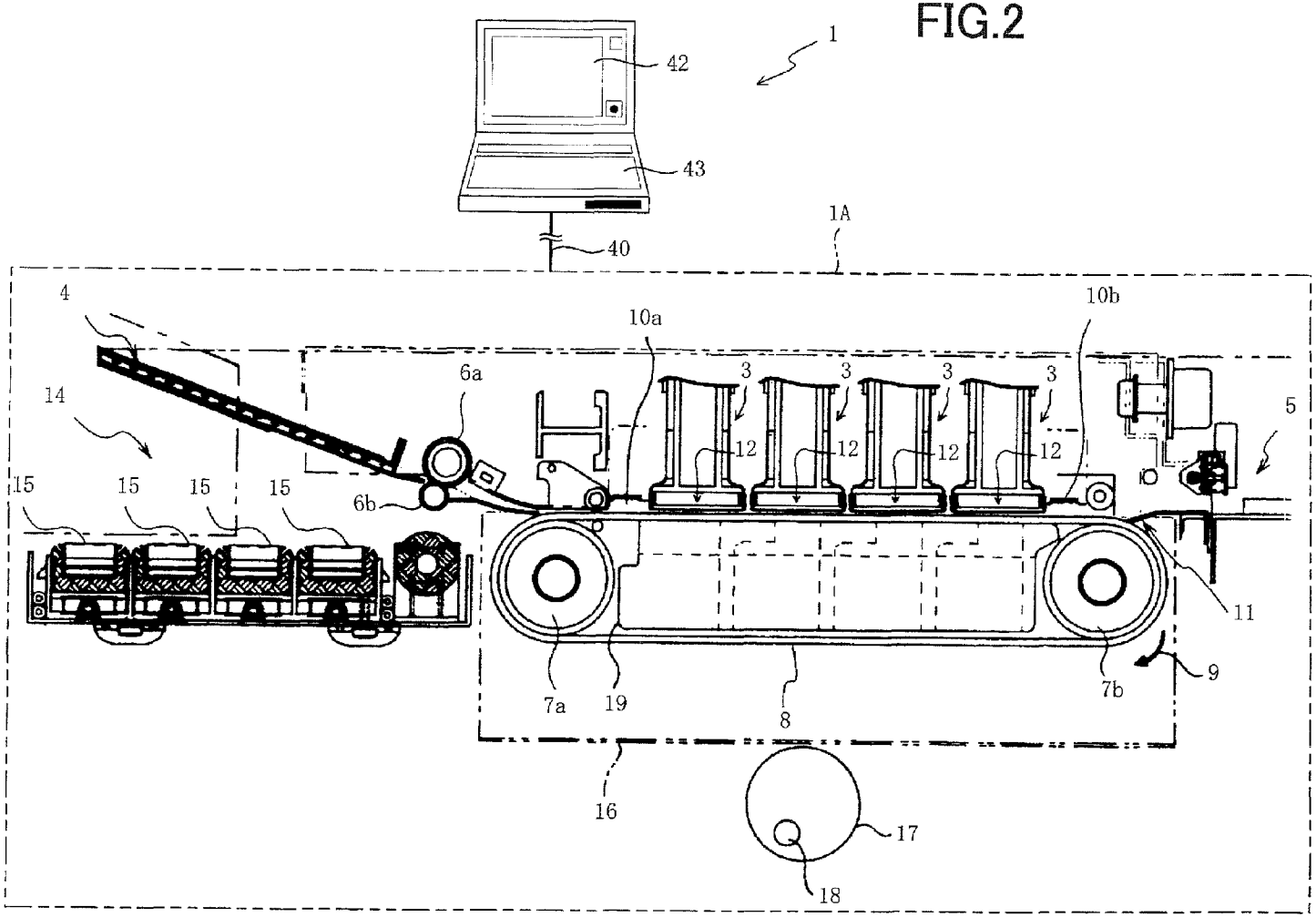
FIG. 2 is a schematic diagram showing a personal computer functioning as a controller for an inkjet recording device, which is one of the present inventions, and an inkjet printer connected to the PC via a communication cable.

Next, preferred embodiments of the present invention will be described while referring to the accompanying drawings. FIG. 2 is a schematic diagram showing a personal computer 1 (hereinafter referred to as "PC 1") functioning as a controller for an inkjet recording device, which is one of the present inventions, and an inkjet printer 1A (hereinafter referred to as "printer 1A") connected to the PC 1 via a communication cable 40.

The PC 1 outputs instructions to the printer 1A through the communication cable 40 instructing the printer 1A to eject ink droplets through nozzles onto a printing medium so that the droplets that land on the printing medium are a prescribed size corresponding to print data. The PC 1 includes an LCD 42 for displaying an output image and the like, and a keyboard 43 for inputting a command to print out data on the printer 1A, for example.

The controller for an inkjet recording device can also be implemented by a computational device other than the PC 1, such as a tablet PC or a PDA. Further, the communicating means for outputting instructions from the PC 1 to the printer 1A may be implemented by a wireless LAN module or other Wi-Fi device instead of the communication cable 40.

The printer 1A is a color inkjet printer having four inkjet heads 3. The PC 1 ejects ink droplets through nozzles formed in each inkjet head 3 onto a printing medium according to instructions outputted from the PC 1. The ink droplets impact the printing medium to form images thereon.

The printer 1A also includes a feeding unit 4 disposed in the left side of the drawing and a discharge unit 5 disposed on the right side. A paper-conveying path is formed in the printer 1A for conveying the printing medium from the feeding unit 4 to the discharge unit 5.

A pair of heating rollers 6*a* and 6*b* are disposed immediately downstream of the feeding unit 4 for pinching and conveying the printing medium. The heating rollers 6*a* and 6*b* convey the printing medium to the right.

In a center region of the paper-conveying path are provided two belt rollers 7*a* and 7*b* and an endless conveying belt 8 looped around the belt rollers 7*a* and 7*b* and stretched taut therebetween. The outer peripheral surface of the endless conveying belt 8, which is the conveying surface, is treated with silicon to produce a tackiness that enables the conveying surface of the endless conveying belt 8 to grip the printing medium conveyed from the heating rollers 6*a* and 6*b* and convey the printing medium downstream (rightward) when the belt roller 7*a* is driven to rotate clockwise in FIG. 2 (the direction indicated by an arrow 9).

Restraining members 10*a* and 10*b* are disposed at insertion and discharge positions corresponding to the belt rollers 7*a* and 7*b*, respectively. The restraining members 10*a* and 10*b* press the printing medium against the conveying surface of the endless conveying belt 8 so that the printing medium does not float off the conveying surface but is reliably gripped thereby.

A peeling mechanism 11 is disposed immediately downstream of the endless conveying belt 8 along the paper-conveying path. The peeling mechanism 11 peels the printing medium from the conveying surface of the endless conveying belt 8 so that the printing medium continues to be conveyed rightward toward the discharge unit 5.

Each of the four inkjet heads 3 has a head body 12 formed on the bottom thereof. The head bodies 12 are fixedly disposed in close proximity to each other. Each head body 12 has a rectangular cross-section with the longitudinal dimension oriented orthogonal to the paper-conveying direction. In other words, the printer 1A is a line printer. The bottom surface of each head body 12 faces the paper-conveying path and has a plurality of micro size nozzles formed therein. The four head bodies 12 eject ink droplets in the respective colors magenta, yellow, cyan, and black.

Each inkjet head 3 is a line head having a plurality of nozzles formed at a prescribed pitch in the main scanning direction. The inkjet heads 3 are fixed to a frame of the printer 1A. The printer 1A conveys the printing medium in a sub-scanning direction H. By moving the inkjet heads 3 and the printing medium relative to each other and ejecting ink droplets from the inkjet heads 3 while the printing medium is conveyed, the PC 1 forms an image on the printing medium.

The conveying direction of the printing medium in the preferred embodiment corresponds to the relative displacement direction. It is also possible to move the inkjet head 3 while the position of the printing medium is fixed. In such a case, the moving direction of the inkjet head 3 would correspond to the relative displacement direction.

The head bodies 12 are arranged so that a small gap is formed between the bottom surfaces thereof and the conveying surface of the endless conveying belt 8. The paper-conveying path is formed through these gaps. With this construction, as the printing medium conveyed on the endless conveying belt 8 passes directly below each of the four head bodies 12 in sequence, ink droplets in the respective colors of the inkjet heads 3 are ejected through nozzles and onto the top surface of the printing medium, which is the printing surface, thereby forming a desired color image on the printing medium.

The printer 1A also includes a maintenance unit 14 for automatically performing maintenance on the inkjet heads 3. The maintenance unit 14 includes four caps 15 for covering the bottom surfaces of the four head bodies 12, a purging mechanism (not shown), and the like.

The maintenance unit 14 is positioned directly beneath the feeding unit 4 (retracted position) when the printer 1A performs a printing operation. If a prescribed condition is met after completing the printing operation (for example, if a printing operation has not been performed over a continuous prescribed time or if the power to the printer 1A is shut off), the maintenance unit 14 is moved to a position directly beneath the four head bodies 12 (capping position) and the caps 15 of the maintenance unit 14 cover the lower surfaces of the respective head bodies 12 to prevent ink in the nozzle regions of the head bodies 12 from drying out.

The belt rollers 7*a* and 7*b* and the endless conveying belt 8 are supported in a chassis 16. The chassis 16 is supported on a cylindrical member 17 disposed directly therebelow. The member 17 is rotatably provided about a shaft 18 mounted in the member 17 at an eccentric position. Accordingly, the height to the top of the member 17 varies as the shaft 18 rotates, causing the chassis 16 to rise and fall. When moving the chassis 16 from the receded position to the capping position, the member 17 is first rotated to a prescribed angle for lowering the chassis 16, endless conveying belt 8, and belt rollers 7*a* and 7*b* a prescribed distance from the position shown in FIG. 2, thereby opening up sufficient space for accommodating the maintenance unit 14.

A guide 19 shaped substantially like a rectangular parallelepiped (having a width similar to that of the endless conveying belt 8) is disposed in the area surrounded by the endless conveying belt 8 for supporting the endless conveying belt 8 at a position opposite the head bodies 12. In other words, the guide 19 contacts the bottom surface of the endless conveying belt 8 from the inside along a section of the endless conveying belt 8 where the top side opposes the head bodies 12.

Figure 3:
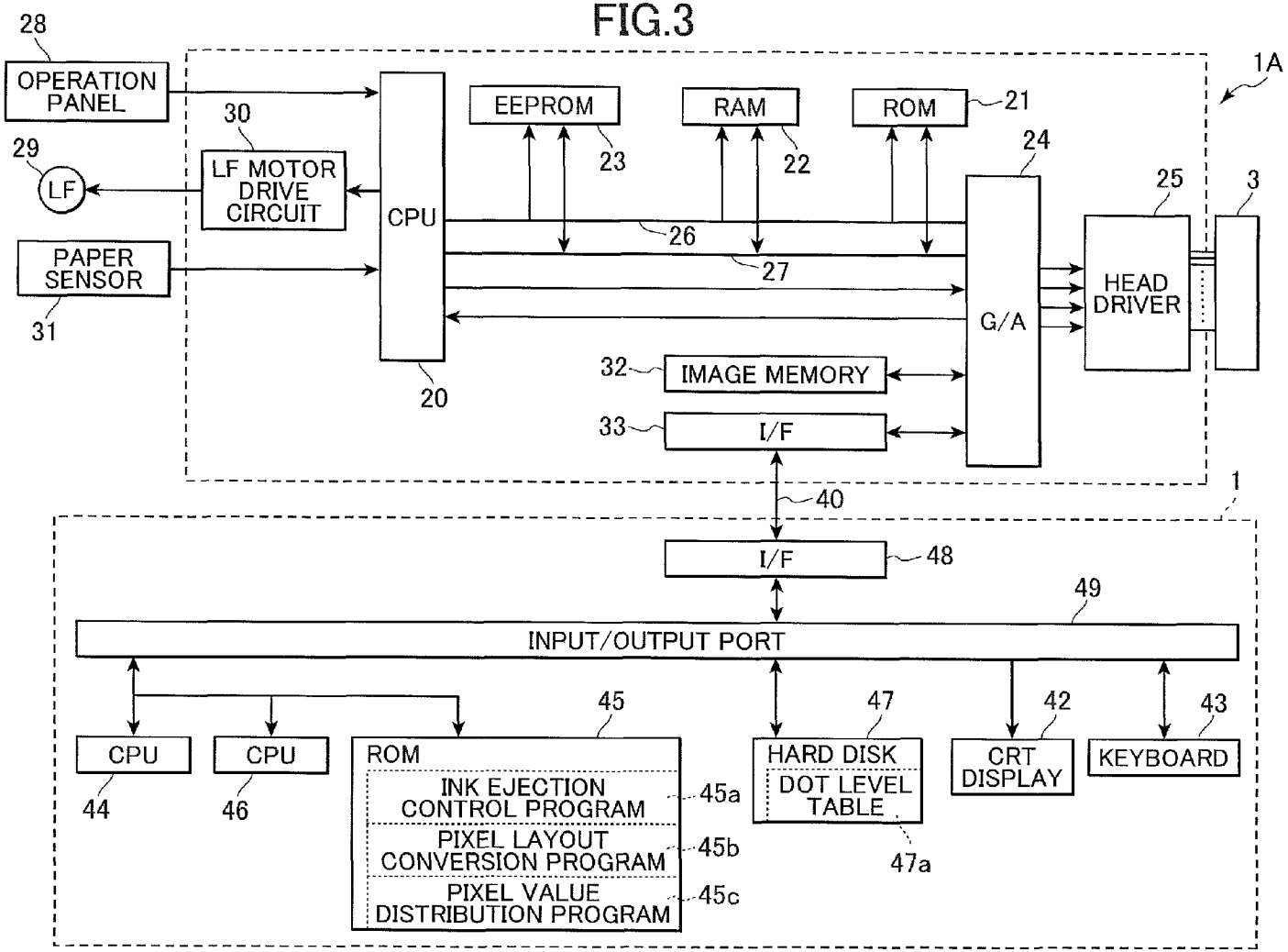
FIG. 3 is a block diagram showing the general structure of an electric circuit in the PC and printer.

FIG. 3 is a block diagram showing the general structure of an electric circuit in the PC 1 and printer 1A. The PC 1 includes a CPU 44, a hard disk 47, an interface 48, an LCD 42, and a keyboard 43, all of which are connected via an input/output port 49.

The CPU 44 is further connected to a ROM 45, and a RAM 46 via a data bus. The CPU 44 functions to execute various programs stored in the ROM 45.

The ROM 45 is a non-rewritable, nonvolatile memory storing an ink ejection control program 45*a*, a pixel layout conversion program 45*b*, a pixel value distribution program 45*c* and various other control programs executed by the CPU 44, fixed data, and the like. Based on the ink ejection control program 45*a*, the CPU 44 outputs instructions to the printer 1A to eject ink droplets from the nozzles so that the size of the ink droplet after impacting the printing medium is greater than or smaller than a prescribed size corresponding to print data.

With the pixel layout conversion program 45*b*, the CPU 44 converts the pixel layout in the original print data and arranges the pixels in the new layout. For example, this program converts the pixel layout of original print data, such as that shown in FIG. 10(*a*), to the layout shown in FIG. 10(*b*) or in FIG. 10(*c*).

With the pixel value distribution program 45*c*, the CPU 44 sets values for each pixel in the pixel layout converted with the pixel layout conversion program 45*b*. Specifically, this program implements the steps in the flowchart of FIG. 13.

The RAM 46 is a rewritable volatile memory for temporarily storing various data and the like.

The hard disk 47 is a rewritable, nonvolatile memory and stores a dot level table 47*a*. The dot level table 47*a* stores a parameter for each nozzle as a dot level. The parameters indicate instructions by which the sizes of ink droplets ejected from the nozzles form prescribed sizes after impacting the printing medium. The ink ejection control program 45*a* outputs instructions for ejecting ink droplets of the prescribed sizes from each nozzle based on the parameters stored in the dot level table 47*a*.

The interface 48 is connected to an interface 33 of the printer 1A described later via the communication cable 40 and serves as communicating means for outputting print data to the printer 1A.

The printer 1A includes a microcomputer (CPU) 20 configured on a single chip, a ROM 21, a RAM 22, a EEPROM 23, a gate array (G/A) 24, and a head driver 25. The CPU 20, ROM 21, RAM 22, EEPROM 23, gate array 24, and head driver 25 are interconnected via an address bus 26 and a data bus 27.

The CPU 20 is an arithmetic unit that executes processes based on control programs stored in the ROM 21 to control the ejection of ink droplets, and various detections for the amount of residual ink in the cartridges, the existence of ink, and the like. The CPU 20 generates ejection timing signals and reset signals and transfers these signals to the gate array 24 described later.

The CPU 20 is also connected to a operation panel 28 through which the user can input print commands and the like, a motor drive circuit 30 for actuating a conveying motor (LF motor) 29 to convey a printing medium, and a paper sensor 31 for detecting the leading edge of the printing medium. The CPU 20 controls the operations of these devices.

The ROM 21 is a non-rewritable, nonvolatile memory and stores various control programs executed by the CPU 20 to control the ejection of ink droplets, fixed data, and the like. The RAM 22 is a rewritable, volatile memory for temporarily storing various data and the like. The EEPROM 23 is a rewritable, nonvolatile memory.

In response to print timing signals transferred from the CPU 20, the gate array 24 outputs various signals to the head driver 25 based on image data stored in an image memory 32. Signals outputted by the gate array 24 include print data (drive signals) for printing the image data on a printing medium, a transfer clock CLK for synchronizing with the print data, a latch signal, a parameter signal for generating a basic print wave signal, and an ejection timing signal JET outputted at a constant frequency.

The gate array 24 stores print data in the image memory 32 that has been transferred from the PC 1 through the interface 33.

The head driver 25 is a drive circuit that, in response to a signal outputted from the gate array 24, applies a drive pulse having a waveform conforming to this signal to drive elements corresponding to each nozzle. The drive pulse actuates the drive elements to eject ink droplets from the nozzles.

Next, a control process according to a first embodiment will be described with reference to FIG. 4, the control process being executed by the PC 1 having the structure described above. FIG. 4(*a*) shows various sizes of dots (1)-(4) formed when ink droplets ejected from nozzles 35*a*-35*d* of the printer 1A impact the printing medium. FIG. 4(*b*) illustrates relationships between nozzles 35*a*-35*e* and dots formed by ink droplets ejected from these nozzles. FIG. 4(*c*) shows the dot level table 47*a*.

As shown in FIG. 4(*a*), the printer 1A is configured to form dots of the four sizes (1)-(4) based on print data received from the PC 1. More specifically, the dot shown in (1) is the smallest that can be formed, the dot shown in (2) is larger than that shown in (1), the dot shown in (3) is larger than that shown in (2), and the dot shown in (4) is the largest dot that can be formed. However, the printer 1A of the present invention is not limited to forming only four sizes of dots.

As shown in FIG. 4(*b*), the inkjet head 3 of the printer 1A is a line head having a plurality of nozzles arranged in a line at a prescribed pitch P. FIG. 4(*b*) shows five nozzles 35*a*-35*e*.

Here, the nozzles 35*a*-35*e* are actually not arranged in the same line but are each disposed in one of a plurality of lines in the line head. In other words, FIG. 4 shows the nozzles 35*a*-35*e* that eject ink droplets for forming dots within the same line as being themselves arranged in the same line.

The printer 1A forms an image on a printing medium by ejecting ink droplets from the nozzle 35*a* and the like of the inkjet head 3, which is fixed in position, while conveying the printing medium. In this example, it will be assumed that ink droplets ejected from the nozzle 35*c* follows a slanted trajectory with respect to the printing medium (toward the nozzle 35*d*) due to some factor.

Figure 1A:
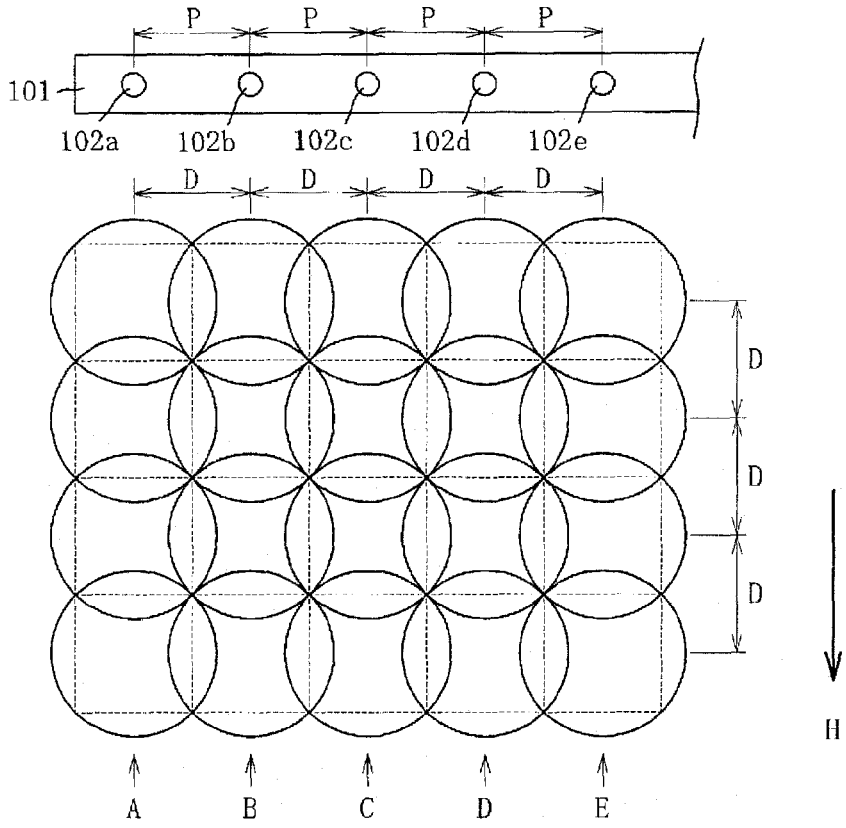
FIG.1(a) Prior Art
FIG. 1(*a*) illustrates the ideal relationship between nozzles and dots formed on a printing medium for a conventional inkjet recording device.
Figure 1B:
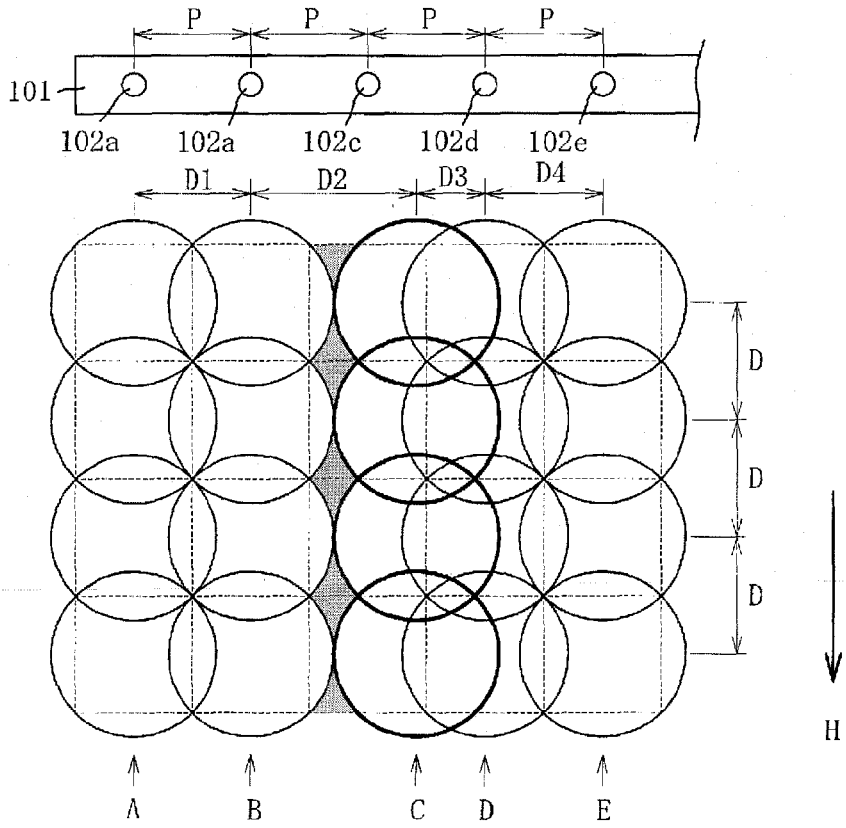
FIG.1(b) Prior Art

For example, when the nozzles 35*a*-35*e* eject ink droplets to form the size of dot shown in (2) of FIG. 4(*a*), as described in FIG. 1(*b*), a pitch D2 greater than the prescribed pitch P is formed between a row of dots B and a row of dots C. Consequently, a gap is produced between the rows of dots B and C that appears as a streak S along a conveying direction H of the printing medium.

Therefore, as shown in FIG. 4(*b*) of the first embodiment, the PC 1 instructs the printer 1A to eject an ink droplet from the nozzle 35*c* that forms a dot with a surface area larger than that specified in the print data and to eject an ink droplet from the nozzle 35*d* that forms a dot with a surface area smaller than that specified in the print data.

In other words, in the first embodiment, when neighboring nozzles 35*b* and 35*c* eject ink droplets that impact positions forming a greater pitch between the neighboring dots than the prescribed pitch, the PC 1 instructs the printer 1A to increase the dot size corresponding to the nozzle 35*c* and also to decrease the size of the dot corresponding to the nozzle 35*d*, which is largely overlapped by the dot corresponding to the nozzle 35*c*. In other words, of the two nozzles 35*b* and 35*d* positioned on either side of the nozzle 35*c*, the nozzle 35*d* produces a dot having a shorter pitch to the dot formed by the nozzle 35*c*. Therefore, the nozzle 35*d* is configured to eject an ink droplet to form a dot of a smaller size than the prescribed size corresponding to the print data.

In order to form dots as described above, the dot level table 47*a* shown in FIG. 4(*c*) stores nozzle position numbers and corresponding dot levels. The nozzle position numbers are assigned to corresponding nozzles 35*a*-35*e*. The dot level indicates an instruction for forming a dot of a prescribed size when the ink droplet ejected from the respective nozzles 35*a*-35*e* impacts the printing medium.

Specifically, the dot level table 47*a* stores the nozzle position number "1" and the dot level "0" for the nozzle 35*a*, the nozzle position number "2" and the dot level "0" for the nozzle 35*b*, the nozzle position number "3" and the dot level "+2" for the nozzle 35*c*, the nozzle position number "4" and the dot level "−1" for the nozzle 35*d*, and the nozzle position number "5" and the dot level "0" for the nozzle 35*e*. The PC 1 outputs instructions to the printer 1A for ejecting ink droplets from each of the nozzles toward the printing medium based on the dot level table 47*a*.

For example, when outputting instructions to the printer 1A for forming the dot shown in (2) of FIG. 4(*a*) with the nozzles 35*a*-35*e* based on the print data, the PC 1 outputs instructions corresponding to the print data for each of the nozzles 35*a*, 35*b*, and 35*e*, which are set to the dot level "0" based on the dot level table 47*a*. Accordingly, the dots formed by these nozzles on the printing medium has the size shown in (2) of FIG. 4(*a*).

However, for the nozzle 35*c* set to the dot level of "+2", the PC 1 outputs an instruction to the printer 1A to form a dot of the size shown in (4) of FIG. 4(*a*), which size is two levels larger than the size of the dots corresponding to the print data (the size of the dot shown in (2) of FIG. 4(*a*)). Consequently, dots formed on the printing medium by the nozzle 35*c* have the size shown in (4) of FIG. 4(*a*).

Further, for the nozzle 35*d* set to the dot level of "−1", the PC 1 outputs an instruction to the printer 1A for forming a dot of the size shown in (1) of FIG. 4(*a*), which size is one level smaller than the dot size corresponding to the print data (the dot size shown in (2) of FIG. 4(*a*)). Accordingly, dots formed on the printing medium by the nozzle 35*d* have the size shown in (1) of FIG. 4(*a*).

More specifically, the PC 1 outputs an instruction to have the head driver 25 apply a voltage to the inkjet head 3 based on the dot level, where the dot level "0" is the reference level. The instruction indicates a voltage of 20 V for drive elements driving the nozzle 35*a* and the like set to the reference level "0", a voltage of 30 V for the drive element driving the nozzle 35*c* set to the dot level "+2", and a voltage of 15 V for the drive element driving the nozzle 35*d* set to the "−1".

In response, the drive elements to which a voltage of 20 V was applied eject ink droplets of 10 pl from the nozzles 35*a*, 35*b*, and 35*d*, the drive element to which a voltage of 30 V was applied ejects an ink droplet of 15 pl from the nozzle 35*c*, and the drive element to which a voltage of 15 V was applied ejects an ink droplet of 7.5 pl from the nozzle 35*d*, for example. In other words, the ink droplets ejected from the nozzles 35*a*-35*e* are of an amount substantially proportional to the voltages applied to the drive elements.

As a result, the ink droplets ejected from the nozzles 35*a*, 35*b* and 35*e* form dots of the size indicated in (2) of FIG. 4(*a*) on the printing medium; the ink droplet ejected from the nozzle 35*c* forms a dot of the size indicated in (4) of FIG. 4(*a*), which is two levels larger than the dot size indicated in (2) of FIG. 4(*a*); and the ink droplet ejected from the nozzle 35*d* forms a dot of the size indicated in (1) of FIG. 4(*a*), which is one level smaller than the dot shown in (2) of FIG. 4(*a*).

In the first embodiment described above, the nozzle 35*c* of adjacent nozzles 35*b* and 35*c* whose ejected ink droplets form neighboring dots of a pitch greater than the prescribed pitch is controlled to form a larger dot. The resulting row of dots C reduces the gap formed between the rows of dots C and D produced by ink droplets corresponding to the print data, thereby forming an image of high quality.

However, when the size of dots corresponding to the nozzle 35*c* is increased, the degree to which these dots overlap dots corresponding to the nozzle 35*d* also increases. Since the density in this overlapped area is greater than that in other areas, the image quality drops due to the uneven density.

However, by reducing the size of dots corresponding to the nozzle 35*d*, it is possible to reduce the amount of overlap between dots corresponding to the nozzle 35*c* and nozzle 35*d*, even when increasing the size of dots corresponding to the nozzle 35*c*. This method can prevent a drop in image quality.

Further, the dot level "+2" is set for the nozzle 35*c* according to the degree to which ink ejected from the nozzle 35*c* approaches the nozzle 35*d*. Put another way, the dot level is set based on the size of the gap produced between the rows of dots C and D generated by ink droplets corresponding to the print data. This gap size can be detected by reading the density with a CCD line scan or the like.

The example in the preferred embodiment described above describes a case in which the dots corresponding to the nozzles 35*b* and 35*c* are formed at a pitch D2. However, if the dots corresponding to these nozzles are formed at a pitch smaller than the pitch D2 but greater than the pitch P, then obviously the dot level set for the nozzle 35*c* can be reduced from "+2" to "+1" since the gap is smaller. In this case, the dots formed by ink droplets ejected from the nozzle 35*c* are of the size indicated in (3) of FIG. 4(*a*), which is smaller than the size of the dot indicated in (4) of FIG. 4(*a*).

In this way, it is possible to fill gaps between dots by setting the size of the dots according to the degree of gap, while preventing irregular density levels caused by excessive overlap between neighboring dots.

Further, the dot level table 47*a* is stored on the rewritable hard disk 47 so that settings can be configured for each nozzle. Therefore, if the nozzle 35*a* ejects ink droplets in a direction away from the nozzle 35*b* due to some factor in addition to the problem of the nozzle 35*c*, for example, the gap produced between the rows of dots A and B with ink droplets corresponding to the print data can also be reduced. In this case, the dot level for the nozzle 35*a* is changed from "0" to "+1" to increase the size of dots formed by the nozzle 35*a*, for example. This change increases the size of dots produced by the nozzle 35*a* one level to reduce the gap formed between the rows of dots A and B, thereby maintaining a high image quality over a long period.

Next, a control process according to a second embodiment will be described with reference to FIG. 5, the control process being executed by the PC 1 having the structure described above. FIG. 5(*a*) shows various sizes of dots (1)-(4) formed when ink droplets ejected from nozzles 35*a*-35*d* of the printer 1A impact the printing medium. FIG. 5(*b*) illustrates relationships between nozzles 35*a*-35*e* and dots formed by ink droplets ejected from these nozzles. FIG. 5(*c*) shows the dot level table 47*a*.

The second embodiment, as in the first embodiment described in FIG. 4, assumes the case of some factor causing the nozzle 35*c* of the nozzles 35*a*-35*e* to eject ink droplets in a slanted direction with respect to the printing medium (toward the nozzle 35*d*), producing a gap between rows of dots C and B formed by ink droplets corresponding to the print data.

Therefore, in the second embodiment, the PC 1 instructs the printer 1A to eject an ink droplet from the nozzle 35*b* that forms a dot with a surface area larger than that specified in the print data and to eject an ink droplet from the nozzle 35*a* that forms a dot with a surface area smaller than that specified in the print data.

In other words, in the second embodiment, when neighboring nozzles 35*b* and 35*c* eject ink droplets that impact positions forming a greater pitch between the neighboring dots than the prescribed pitch, the PC 1 instructs the printer 1A to increase the dot size corresponding to the nozzle 35*b* and also to decrease the dot size corresponding to the nozzle 35*a*, the nearest nozzle among nozzles 35*a* and 35*c* positioned on both sides of the nozzle 35*b* that is largely overlapped by the dot corresponding to the nozzle 35*b*. In other words, of the two nozzles 35*a* and 35*c* positioned on either side of the nozzle 35*b*, the nozzle 35*a* produces a dot having a shorter pitch to the dot formed by the nozzle 35*b*. Therefore, the nozzle 35*a* is configured to eject an ink droplet to form a dot of a smaller size than the prescribed size corresponding to the print data.

Hence, as shown in FIG. 5(*c*), the dot level table 47*a* in the second embodiment stores the nozzle position number "1" and the dot level "−1" for the nozzle 35*a*, the nozzle position number "2" and the dot level "+2" for the nozzle 35*b*, the nozzle position number "3" and the dot level "0" for the nozzle 35*c*, the nozzle position number "4" and the dot level "0" for the nozzle 35*d*, and the nozzle position number "5" and the dot level "0" for the nozzle 35*e*.

For example, when outputting instructions to the printer 1A for forming the dot shown in (2) of FIG. 5(*a*) with the nozzles 35*a*-35*e* based on the print data, the PC 1 outputs instructions corresponding to the print data for each of the nozzles 35*c*, 35*d*, and 35*e*, which are set to the dot level "0" based on the dot level table 47*a*. Accordingly, the dots formed by these nozzles on the printing medium has the size shown in (2) of FIG. 5(*a*).

However, for the nozzle 35*b* set to the dot level of "+2", the PC 1 outputs an instruction to the printer 1A to form a dot of the size shown in (4) of FIG. 5(*a*), which size is two levels larger than the size of the dots corresponding to the print data (the size of the dot shown in (2) of FIG. 5(*a*)). Consequently, dots formed on the printing medium by the nozzle 35*b* have the size shown in (4) of FIG. 5(*a*).

Further, for the nozzle 35*a* set to the dot level of "−1", the PC 1 outputs an instruction to the printer 1A for forming a dot of the size shown in (1) of FIG. 5(*a*), which size is one level smaller than the dot size corresponding to the print data (the dot size shown in (2) of FIG. 5(*a*)). Accordingly, dots formed on the printing medium by the nozzle 35*a* have the size shown in (1) of FIG. 5(*a*).

By increasing the size of dots corresponding to the nozzle 35*b* instead of the nozzle 35*c*, as described in the second embodiment, the resulting row of dots B can decrease the gap formed between rows of dots B and C formed by ink droplets corresponding to the print data, as in the first embodiment, thus making the gap unnoticeable and forming images of a high quality.

It is also possible to reduce the overlapping area between the dots corresponding to the nozzle 35*b* and the dots corresponding to the nozzle 35*a* by reducing the size of dots corresponding to the nozzle 35*a*, as in the first embodiment, thereby preventing a drop in image quality.

Next, a control process according to a third embodiment will be described with reference to FIG. 6, the control process being executed by the PC 1 having the structure described above. FIG. 6(*a*) shows various sizes of dots (1)-(4) formed when ink droplets ejected from nozzles 35*a*-35*d* of the printer 1A impact the printing medium. FIG. 6(*b*) illustrates relationships between nozzles 35*a*-35*e* and dots formed by ink droplets ejected from these nozzles. FIG. 6(*c*) shows the dot level table 47*a*.

The third embodiment, as in the first and second embodiments, assumes the case of some factor causing the nozzle 35*c* of the nozzles 35*a*-35*e* to eject ink droplets in a slanted direction with respect to the printing medium (toward the nozzle 35*d*), producing a gap between rows of dots C and B formed by ink droplets corresponding to the print data.

Therefore, in the third embodiment, the PC 1 instructs the printer 1A to eject ink droplets from the nozzles 35*b* and 35*c* that form dots with a surface area larger than that specified in the print data and to eject ink droplets from the nozzles 35*a* and 35*d* that form dots with a surface area smaller than that specified in the print data.

In other words, in the third embodiment, when neighboring nozzles 35*b* and 35*c* eject ink droplets that impact positions forming a greater pitch between the neighboring dots than the prescribed pitch, the PC 1 instructs the printer 1A to increase the dot size corresponding to both nozzles 35*b* and 35*c* and also to decrease the dot size corresponding to both nozzles 35*a* and 35*d* positioned on both sides of the nozzles 35*b* and 35*c* that are largely overlapped by the dots corresponding to the nozzles 35*b* and 35*c*.

Hence, as shown in FIG. 6(*c*), the dot level table 47*a* in the third embodiment stores the nozzle position number "1" and the dot level "−1" for the nozzle 35*a*, the nozzle position number "2" and the dot level "+1" for the nozzle 35*b*, the nozzle position number "3" and the dot level "+1" for the nozzle 35*c*, the nozzle position number "4" and the dot level "−1" for the nozzle 35*d*, and the nozzle position number "5" and the dot level "0" for the nozzle 35*e*.

For example, when outputting instructions to the printer 1A for forming the dot shown in (2) of FIG. 6(*a*) with the nozzles 35*a*-35*e* based on the print data, the PC 1 outputs instructions corresponding to the print data for the nozzle 35*e*, which is set to the dot level "0" based on the dot level table 47*a*. Accordingly, the dots formed by this nozzle on the printing medium has the size shown in (2) of FIG. 6(*a*).

However, for the nozzles 35*b* and 35*c* set to the dot level of "+1", the PC 1 outputs instructions to the printer 1A to form a dot of the size shown in (3) of FIG. 6(*a*), which size is one level larger than the size of the dots corresponding to the print data (the size of the dot shown in (2) of FIG. 6(*a*)). Consequently, dots formed on the printing medium by the nozzles 35*b* and 35*c* have the size shown in (3) of FIG. 6(*a*).

Further, for the nozzles 35*a* and 35*d* set to the dot level of "−1", the PC 1 outputs instructions to the printer 1A for forming a dot of the size shown in (1) of FIG. 6(*a*), which size is one level smaller than the dot size corresponding to the print data (the dot size shown in (2) of FIG. 6(*a*)). Accordingly, dots formed on the printing medium by the nozzles 35*a* and 35*d* have the size shown in (1) of FIG. 6(*a*).

As described above in the third embodiment, instead of increasing the dot size corresponding to one of the nozzle 35*b* and nozzle 35*c*, as described in the first and second embodiments, it is possible to increase the dot size corresponding to both nozzles 35*b* and 35*c*, using both rows of dots B and C to decrease the gap produced between these rows. By making the gap unnoticeable in this way, it is possible to form high quality images.

Further, by reducing the size of dots corresponding to nozzles 35*a* and 35*d*, it is possible to reduce the amount of overlap between dots produced by the nozzles 35*a* and 35*b* and the amount of overlap between dots produced by the nozzles 35*c* and 35*d*, as described in the first and second embodiments, thereby preventing a drop in image quality.

Further, unlike the methods of the first and second embodiments that increase the size of dots corresponding to one of the nozzles 35*b* and 35*c*, the method of the third embodiment increases the size of dots corresponding to both the nozzles 35*b* and 35*c*. In this case, since the gap produced by ink droplets corresponding to the print data can be decreased using both dots, each dot can be increased by a lesser degree than in the first and second embodiments, thereby suppressing a graininess in the dots and further improving image quality.

Next, a control process according to a fourth embodiment will be described with reference to FIG. 7, the control process being executed by the PC 1 having the structure described above. FIG. 7(*a*) shows various sizes of dots (1)-(4) formed when ink droplets ejected from nozzles 35*a*-35*d* of the printer 1A impact the printing medium. FIG. 7(*b*) illustrates relationships between nozzles 35*a*-35*e* and dots formed by ink droplets ejected from these nozzles. FIG. 7(*c*) shows the dot level table 47*a*.

In the fourth embodiment, some factor causes ink droplets ejected from the nozzle 35*c* of the nozzles 35*a*-35*e* to follow a slanted trajectory with respect to the printing medium (toward the nozzle 35*d*). Additionally, some factor causes ink droplets ejected from the nozzle 35*b* to follow a slanted trajectory relative to the printing medium (toward the nozzle 35*a*). Consequently, ink droplets ejected according to the print data produce a gap between rows of dots B and C that is larger than that described in the first through third embodiments.

In this case, as described in the first or second embodiment, it is possible to reduce the gap produced between the rows of dots B and C by increasing the size of dots corresponding to the nozzles 35*b* or 35*c*.

However, when attempting to reduce a large gap between the rows of dots B and C such as that described in the fourth embodiment by increasing the size of dots corresponding to only one of the nozzles 35*b* and 35*c*, the size of the dots must be increased considerably. In such a case, the large dots will make the image conspicuously grainy. Therefore, as described in the third embodiment, it is preferable in the fourth embodiment to increase the size of dots corresponding to both nozzles 35*b* and 35*c*.

Specifically, as described in the third embodiment, the PC 1 in the fourth embodiment instructs the printer 1A to eject ink droplets from the nozzles 35*b* and 35*c* that form dots of a size larger than the size specified in the print data and to eject ink droplets from the nozzles 35*a* and 35*d* that form dots that are smaller than the size indicated by the print data.

Here, the gap formed between the rows of dots B and C in the fourth embodiment by ejecting ink droplets corresponding to the print data is larger than the gap described in the third embodiment. Therefore, is should be apparent that the size of dots formed by ink droplets ejected from the nozzles 35*b* and 35*c* in the fourth embodiment must be greater than the size of dots formed by ink droplets ejected from the same nozzles in the third embodiment.

Accordingly, as shown in FIG. 7(*c*) the dot level table 47*a* in the fourth embodiment stores the nozzle position number "1" and the dot level "−1" for the nozzle 35*a*, the nozzle position number "2" and the dot level "+2" for the nozzle 35*b*, the nozzle position number "3" and the dot level "+2" for the nozzle 35*c*, the nozzle position number "4" and the dot level "−1" for the nozzle 35*d*, and the nozzle position number "5" and the dot level "0" for the nozzle 35*e*.

For example, when outputting instructions to the printer 1A for forming the dot shown in (2) of FIG. 7(*a*) with the nozzles 35*a*-35*e* based on the print data, the PC 1 outputs instructions corresponding to the print data for the nozzle 35*e*, which is set to the dot level "0" based on the dot level table 47*a*. Accordingly, the dots formed by this nozzle on the printing medium has the size shown in (2) of FIG. 7(*a*).

However, for the nozzles 35*b* and 35*c* set to the dot level of "+2", the PC 1 outputs instructions to the printer 1A to form a dot of the size shown in (4) of FIG. 7(*a*), which size is three levels larger than the size of the dots corresponding to the print data (the size of the dot shown in (2) of FIG. 7(*a*)). Consequently, dots formed on the printing medium by the nozzles 35*b* and 35*c* have the size shown in (4) of FIG. 7(*a*).

Further, for the nozzles 35*a* and 35*d* set to the dot level of "−1", the PC 1 outputs instructions to the printer 1A for forming a dot of the size shown in (1) of FIG. 7(*a*), which size is one level smaller than the dot size corresponding to the print data (the dot size shown in (2) of FIG. 7(*a*)). Accordingly, dots formed on the printing medium by the nozzles 35*a* and 35*d* have the size shown in (1) of FIG. 7(*a*).

In the fourth embodiment described above, a large gap formed between the rows of dots B and C is reduced while preventing graininess by increasing the size of dots corresponding to both nozzles 35*b* and 35*c*.

Next, a control process according to a fifth embodiment will be described with reference to FIG. 8, the control process being executed by the PC 1 having the structure described above. FIG. 8(*a*) shows various sizes of dots (1)-(4) formed when ink droplets ejected from nozzles 35*a*-35*d* of the printer 1A impact the printing medium. FIG. 8(*b*) illustrates relationships between nozzles 35*a*-35*e* and dots formed by ink droplets ejected from these nozzles. FIG. 8(*c*) shows the dot level table 47*a*.

In the fifth embodiment, some factor causes ink droplets ejected from the nozzle 35*c* among the nozzles 35*a*-35*e* to follow a slanted trajectory with respect to the printing medium (toward the nozzle 35*d*). Additionally, some factor causes ink droplets ejected from the nozzle 35*b* to follow a slanted trajectory with respect to the printing medium (toward the nozzle 35*c*). Consequently, a gap is produced between rows of dots A and B when ejecting ink droplets based on the print data. The fifth embodiment assumes that the pitch D2 between the rows of dots B and C is identical to the nozzle pitch P and that a gap is not produced between the rows of dots B and C.

Specifically, the fifth embodiment considers the case of the rows of dots A and B having a pitch D1 greater than the nozzle pitch P, producing a gap between the rows of dots A and B when ejecting ink droplets according to the print data, and the rows of dots C and D having a pitch D3 smaller than the nozzle pitch P.

In the fifth embodiment, the PC 1 instructs the printer 1A to eject ink droplets from the nozzle 35*b* to form dots of a size larger than the size specified in the print data and to eject ink droplets from the nozzle 35*c* to form dots of a size smaller than the size indicated by the print data.

Accordingly, as shown in FIG. 8(*c*) the dot level table 47*a* in the fifth embodiment stores the nozzle position number "1" and the dot level "0" for the nozzle 35*a*, the nozzle position number "2" and the dot level "+2" for the nozzle 35*b*, the nozzle position number "3" and the dot level "−1" for the nozzle 35*c*, the nozzle position number "4" and the dot level "0" for the nozzle 35*d*, and the nozzle position number "5" and the dot level "0" for the nozzle 35*e*.

For example, when outputting instructions to the printer 1A for forming the dot shown in (2) of FIG. 8(*a*) with the nozzles 35*a*-35*e* based on the print data, the PC 1 outputs instructions corresponding to the print data for the nozzles 35*a*, 35*d*, and 35*e*, which are set to the dot level "0" based on the dot level table 47*a*. Accordingly, the dots formed by this nozzle on the printing medium has the size shown in (2) of FIG. 8(*a*).

However, for the nozzle 35*b* set to the dot level of "+2", the PC 1 outputs instructions to the printer 1A to form a dot of the size shown in (4) of FIG. 8(*a*), which size is two levels larger than the size of the dots corresponding to the print data (the size of the dot shown in (2) of FIG. 8(*a*)). Consequently, dots formed on the printing medium by the nozzle 35*b* has the size shown in (4) of FIG. 8(*a*).

Further, for the nozzle 35*c* set to the dot level of "−1", the PC 1 outputs instructions to the printer 1A for forming a dot of the size shown in (1) of FIG. 8(*a*), which size is one level smaller than the dot size corresponding to the print data (the dot size shown in (2) of FIG. 8(*a*)). Accordingly, dots formed on the printing medium by the nozzle 35*c* has the size shown in (1) of FIG. 8(*a*).

In the fifth embodiment described above, a gap produced between rows of dots A and B by ejecting ink droplets according to the print data can be reduced by increasing the size of dots corresponding to the nozzle 35*b*. It is also possible to prevent a drop in image quality by decreasing the size of dots corresponding to the nozzle 35*c*.

Figure 9A:
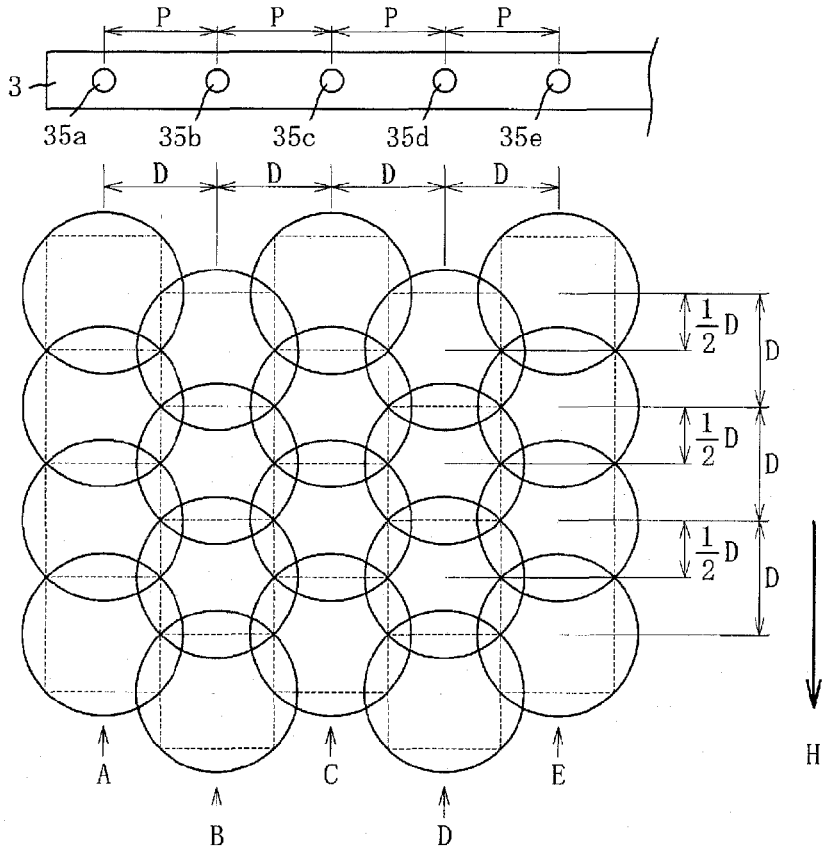
FIG. 9 is related to a sixth embodiment, wherein FIG. 9(*a*) shows the relationship between the nozzles and dots formed by ink droplets ejected from the nozzles.
Figure 9B:
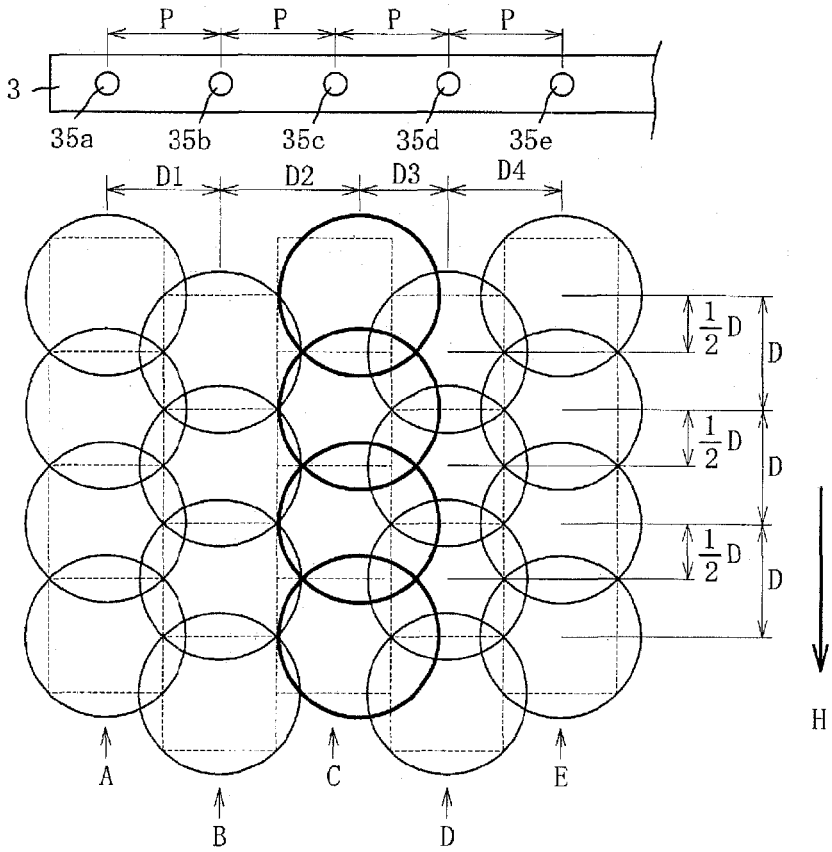
Figure 10A:
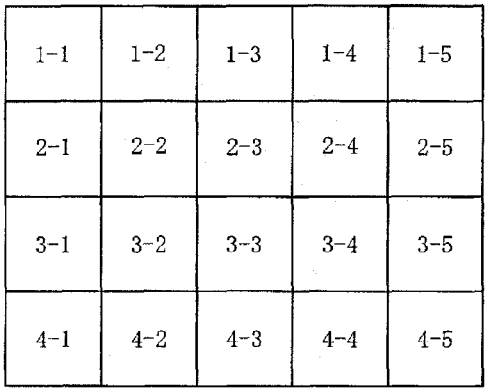
FIG. 10(*a*) shows a pixel layout having four rows and five columns based on the original print data.
Figure 10B:
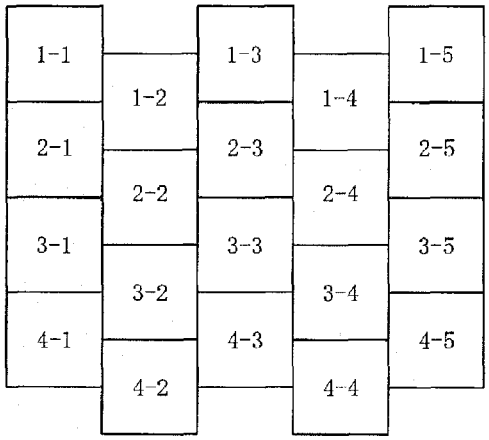
Figure 10C:
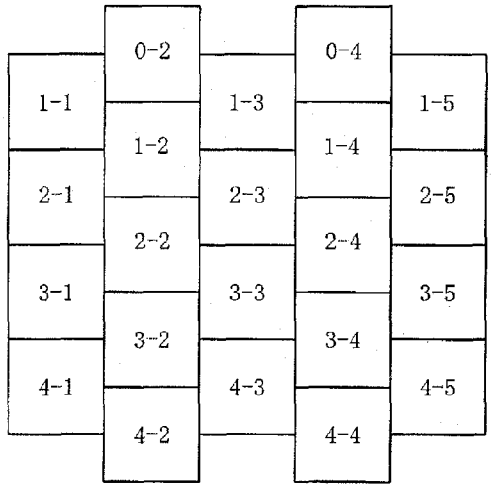
Figure 10D:
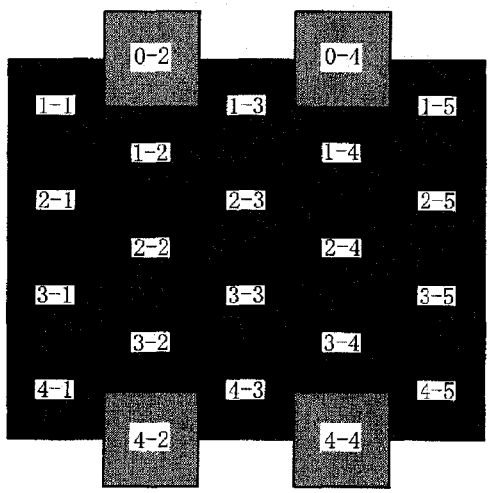

Next, a sixth embodiment for controlling the printer 1A with the PC 1 will be described with reference to FIG. 9. FIG. 9(*a*) shows the relationship between the nozzle 35*a* and the like formed in the inkjet head 3, and dots formed by ink droplets ejected from the nozzle 35*a* and the like. FIG. 9(*b*) shows the same relationship when some factor causes ink droplets ejected from the nozzle 35*c* to impact the printing medium with a bias toward the nozzle 35*d*.

While normally instructions are outputted to the printer 1A to form dots arranged in four rows and five columns, as shown in FIG. 1(*a*), the PC 1 in the sixth embodiment outputs instructions to the printer 1A so that columns of dots B and D are shifted relative to columns of dots A, C, and E in the conveying direction H for conveying the printing medium (hereinafter referred to as the subscanning direction H). In other words, the PC 1 outputs instructions to the printer 1A so that every other column of dots is shifted in the subscanning direction H.

Hence, as described with reference to FIG. 1, if the column of dots C does not impact the printing medium in the expected position shown in FIG. 9(*a*) but impacts at a bias toward the column of dots D due to some factor causing ink droplets ejected from the nozzle 35*c* to have a bias toward the nozzle 35*d* the pitch between the columns of dots B and C, though greater than the prescribed pitch, does not produce a gap as large as that between the columns of dots B and C in FIG. 1(*b*), thereby preventing a decline in image quality.

In this example, the PC 1 outputs instructions to the printer 1A for shifting the columns of dots B and C in the subscanning direction H by approximately half the pitch D (½*D) of dots aligned in the subscanning direction H. Accordingly, this arrangement is most effective at reducing a gap produced between columns of dots B and C that increases the greater the bias of the column of dots C toward the column of dots D.

Next, a detailed method of control for dots formed as shown in FIG. 9 will be described with reference to FIG. 10. FIG. 10(*a*) shows a pixel arrangement having four rows and five columns based on the original print data. FIGS. 10(*b*) and 10(*c*) show converted states of the pixel layout in FIG. 10(*a*). FIG. 10(*d*) shows values set to each pixel in the pixel layout of FIG. 10(*c*) that have been indicated in different colors.

Conventionally, the PC 1 would output instructions to the printer 1A to form dots for each pixel based on the pixel layout in the original print data shown in FIG. 10(*a*), and the printer 1A would eject ink droplets according to the instructions received from the PC 1. This method forms the dots shown in FIG. 1(*a*).

However, in the sixth embodiment, the pixel layout conversion program 45*b* converts the pixel layout shown in FIG. 10(*a*) to the layout shown in FIG. 10(*b*). More specifically, the pixel layout conversion program 45*b* converts the pixel layout so that the second and fourth pixel columns are shifted in the subscanning direction H by half the pitch D in the subscanning direction H (½*D).

Subsequently, the PC 1 outputs an instruction to the printer 1A to form dots for each pixel according to the converted pixel layout shown in FIG. 10(*b*). The printer 1A ejects ink droplets based on these instructions. In this way, it is possible to form dots in the positions of impact shown in FIG. 9(*a*).

If the pixel layout shown in FIG. 10(*a*) is viewed as print data for printing a line-shaped image extending in the main scanning direction orthogonal to the subscanning direction H, then the pixel layout shown in FIG. 10(*b*) can be viewed as print data for forming a staggered image extending in the main scanning direction.

In other words, when converting the original print data for the pixel layout shown in FIG. 10(*a*) to the layout shown in FIG. 10(*b*) with the pixel layout conversion program 45*b*, distortion may appear in the image formed according to this converted pixel layout.

Therefore, in the sixth embodiment, the PC 1 outputs an instruction to the printer 1A to eject an additional ink droplet for one pixel worth in the opposite direction as the shifted direction for each shifted column in order to prevent distortion in the image. Accordingly, the pixel layout conversion program 45*b* converts the pixel layout shown in FIG. 10(*a*) to the layout shown in FIG. 10(*c*) rather than 10(*b*). Specifically, the pixel layout conversion program 45*b* adds new pixels "0-2" and "0-4" in the second and fourth columns, which are the pixel columns shifted in the subscanning direction H, at ends of the columns in the opposite direction from the shifted direction.

Additionally, the PC 1 outputs instructions to the printer 1A to reduce the density of dots corresponding to both ends of columns shifted in the subscanning direction H from the density according to the print data. Accordingly, the pixel value distribution program 45*c* sets the pixel values for pixels "0-2" and "4-2" and pixels "0-4" and "4-4" positioned on both ends of the second and fourth pixel columns shifted in the subscanning direction H lower than the pixel values corresponding to the print data.

Pixel values are set for each pixel and define the density of the dot corresponding to the pixel. For example, the pixel value may be represented by a value from 0 to 255, where a small ink droplet is ejected for pixels set to a value between 0 and 84, medium ink droplets are ejected for pixels set to a value between 85 and 169, and large ink droplets are ejected for a pixel set to a value between 169 and 255.

Ink droplets of a larger size form darker dots. Further, the density of dots formed on the printing medium may be regulated not only by the size of the ink droplet, but also by using a low density ink in colors other than magenta, yellow, cyan, and black.

As an example, each pixel of the original print data shown in FIG. 10(*a*) may be set to the value 250 as the original pixel value. In this case, the printer 1A ejects large ink droplets to form large dots for each pixel based on the pixel value of each pixel.

However, in the sixth embodiment, the PC 1 first converts the pixel layout shown in FIG. 10(*a*) to the layout shown in FIG. 10(*c*) based on the pixel layout conversion program 45*b*, and subsequently distributes part of the original pixel value 250 for the pixel "1-2" (a pixel value of 125) to the pixel "0-2" in the second pixel column based on the pixel value distribution program 45*c*, setting the pixel value for the pixel "0-2" to 125. Here, the pixel value of the pixel "0-2" was originally set to 0 when first added by the pixel layout conversion program 45*b*.

While the pixel "1-2" becomes the pixel value 125 after distributing a portion of the pixel value to the pixel "0-2", a 125 value portion of the original pixel value 250 for the pixel "2-2" is then distributed to the pixel "1-2", returning the value of the pixel "1-2" to its original value of 250.

By repeating this process for each pixel constituting the second column, the pixels "0-2" and "4-2" in the second column are ultimately set to 125, while pixels "1-2" through "3-2" are set to their original values of 250.

The same process is also performed on each pixel constituting the fourth column so that pixels "0-4" and "4-4" in the fourth column are set to the value 125, while pixels "1-4" through "3-4" are set to the value 250. Values of pixels making up the first, third and fifth columns remain at their original pixel values of 250.

The pixel value distribution program 45*c* sets pixels "0-2" and "4-2" and pixels "0-4" and "4-4" positioned on both ends of the second and fourth columns shifted in the subscanning direction H to the pixel value 125, which is half the value 250 corresponding to the print data. In this way, the PC 1 can output instructions to the printer 1A for setting the density of dots corresponding to pixels "0-2" and "4-2" and pixels "0-4" and "4-4" less than the density of dots corresponding to the other pixels.

Accordingly, adding the new pixels "0-2" and "0-4" to the pixel layout shown in FIG. 10(*a*) and reducing the density of dots corresponding to the pixels "0-2" and "4-2" and the pixels "0-4" and "4-4" from the density specified in the print data makes the dots formed at pixels "0-2" and "4-2" and the pixels "0-4" and "4-4" less conspicuous and, hence, forms an image closer to a line shape than when simply converting the pixel layout in FIG. 10(*a*) to the layout shown in FIG. 10(*b*) and outputting instructions to form dots corresponding to the converted pixel layout. Therefore, this method can prevent distortion in line-shaped images.

Figure 11A:
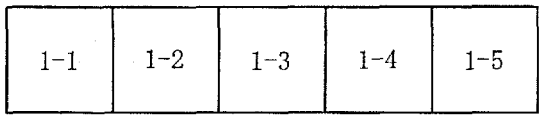
FIG. 11(*b*) shows a converted state of the pixel layout of FIG. 11(*a*).
Figure 11B:
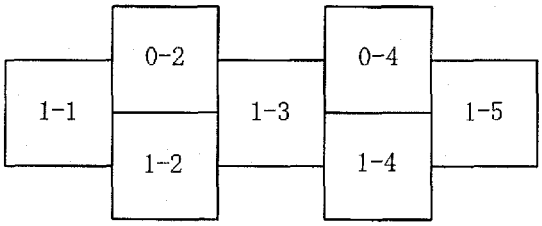
Figure 11C:
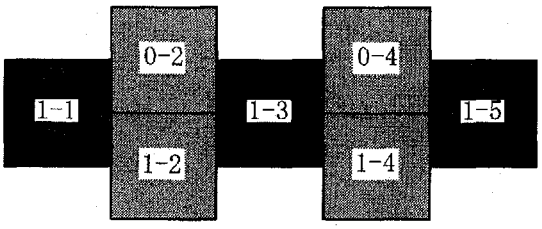

Next, a case of printing a line-shaped image finer than the previous image will be described with reference to FIG. 11. FIG. 11(*a*) shows the pixel layout based on the original print data. FIG. 11(*b*) shows the pixel layout of FIG. 11(*a*) after being converted. FIG. 11(*c*) shows pixel values that have been indicated in different colors for each pixel in the layout of FIG. 11(*b*).

As described above, before outputting instructions to the printer 1A to eject ink droplets corresponding to each pixel in the layout shown in FIG. 11(*a*), the layout in FIG. 11(*a*) is converted to the layout shown in FIG. 11(*b*) according to the pixel layout conversion program 45*b*.

More specifically, pixels "1-2" and "1-4" are shifted in the subscanning direction H, and new pixels "0-2" and "0-4" are added to the side of the shifted pixels in the direction opposite the shifted direction.

The pixel value distribution program 45*c* sets the values of each pixel in the layout shown in FIG. 11(*b*) as follows. In this example, each pixel in the original print data shown in FIG. 11(*a*) has been set to the original pixel value 250, while the newly added pixels "0-2" and "0-4" have been set to the pixel value 0.

Specifically, the partial pixel value 125 of the original pixel value 250 for the pixel "1-2" shifted in the subscanning direction H is distributed to the pixel "0-2" so that both the new pixel "0-2" and the pixel "1-2" are set to the pixel value 125. Similarly, the partial pixel value 125 of the original pixel value 250 for the pixel "1-4" shifted in the subscanning direction H is distributed to the pixel "0-4" so that both the new pixel "0-4" and the pixel "1-4" are given the pixel value 125. Pixel values for pixels "1-1", "1-3", and "1-5" remain at 250.

With this process, the pixel value distribution program 45*c* sets the values of pixels "0-2" and "1-2" and pixels "0-4" and "1-4" positioned at both ends of pixel columns shifted in the subscanning direction H to 125, which is half the pixel value of 250 specified in the print data. By doing this, it is possible to output instructions to the printer 1A for setting the density of dots corresponding to the pixels "0-2" and "1-2" and the pixels "0-4" and "1-4" less than the density of dots corresponding to other pixels.

Accordingly, as in the preceding example described above, dots formed at the pixels "0-2" and "1-2" and pixels "0-4" and "1-4" are less conspicuous, even when printing a line-shaped image based on the pixel layout shown in FIG. 11(*a*) that is finer in the main scanning direction than the image shown in FIG. 10. By forming an image that is closer to a line shape, this method can prevent distortion in the line-shaped image.

Figure 12A:
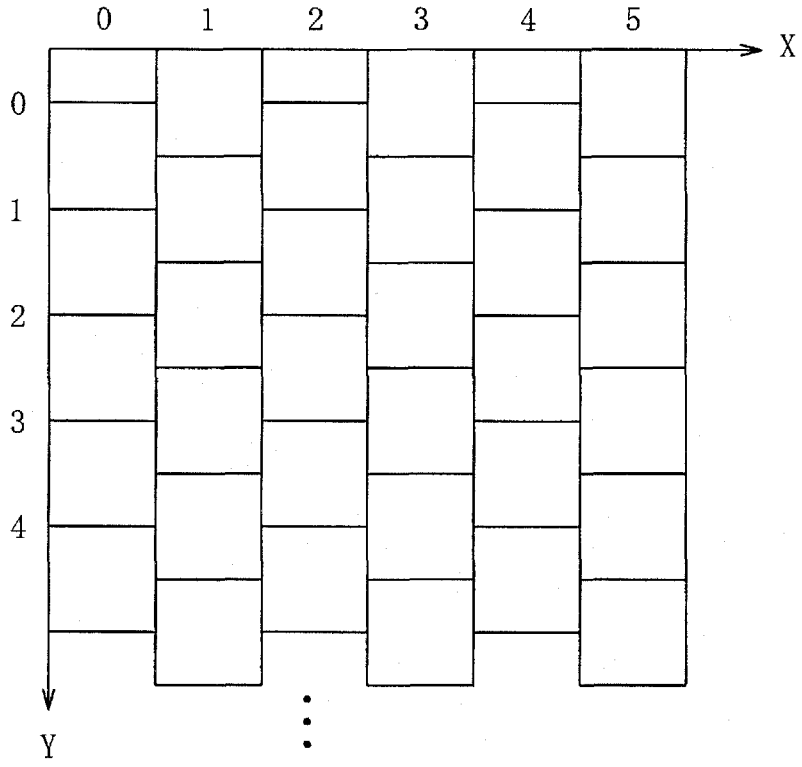
FIG. 12(*a*) shows the converted pixel layout adapted to a coordinate system.
Figure 12B:
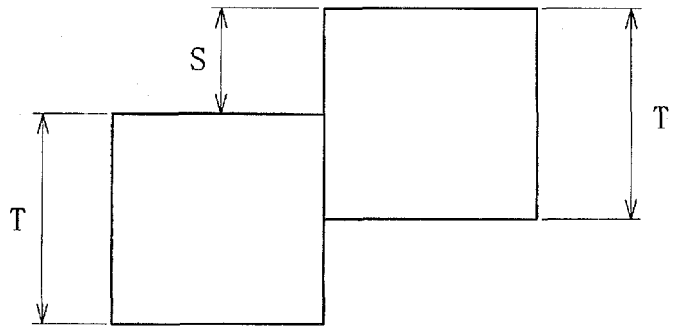

Next, the aforementioned method of setting pixel values will be described with reference to FIGS. 12 and 13. FIG. 12(*a*) shows the state in which the pixel layout conversion program 45*b* has adapted the converted pixels to the XY coordinate system. FIG. 12(*b*) is a partially enlarged view of converted pixels illustrating the method of setting a distribution ratio.

As shown in FIG. 12(*a*), a coordinate system has been assigned to the pixel layout produced by shifting every other column in the subscanning direction H according to the pixel layout conversion program 45*b*. In this coordinate system, the uppermost pixel in the leftmost column is the point of origin, the right direction is the X-axis, and the left direction is the Y-axis.

Here, the value of each pixel is represented as L(X, Y), where X is set in a range from 0 to Xmax and Y is set to a range from 0 to Ymax.

As shown in FIG. 12(*b*), a distribution ratio R of pixel values is set based on the ratio of a shift amount S of the shifted pixels to a length T on one side of each pixel. Since pixels are shifted exactly one half the length of one side in the preferred embodiment, the distribution ratio R is 1/2.

Figure 13:
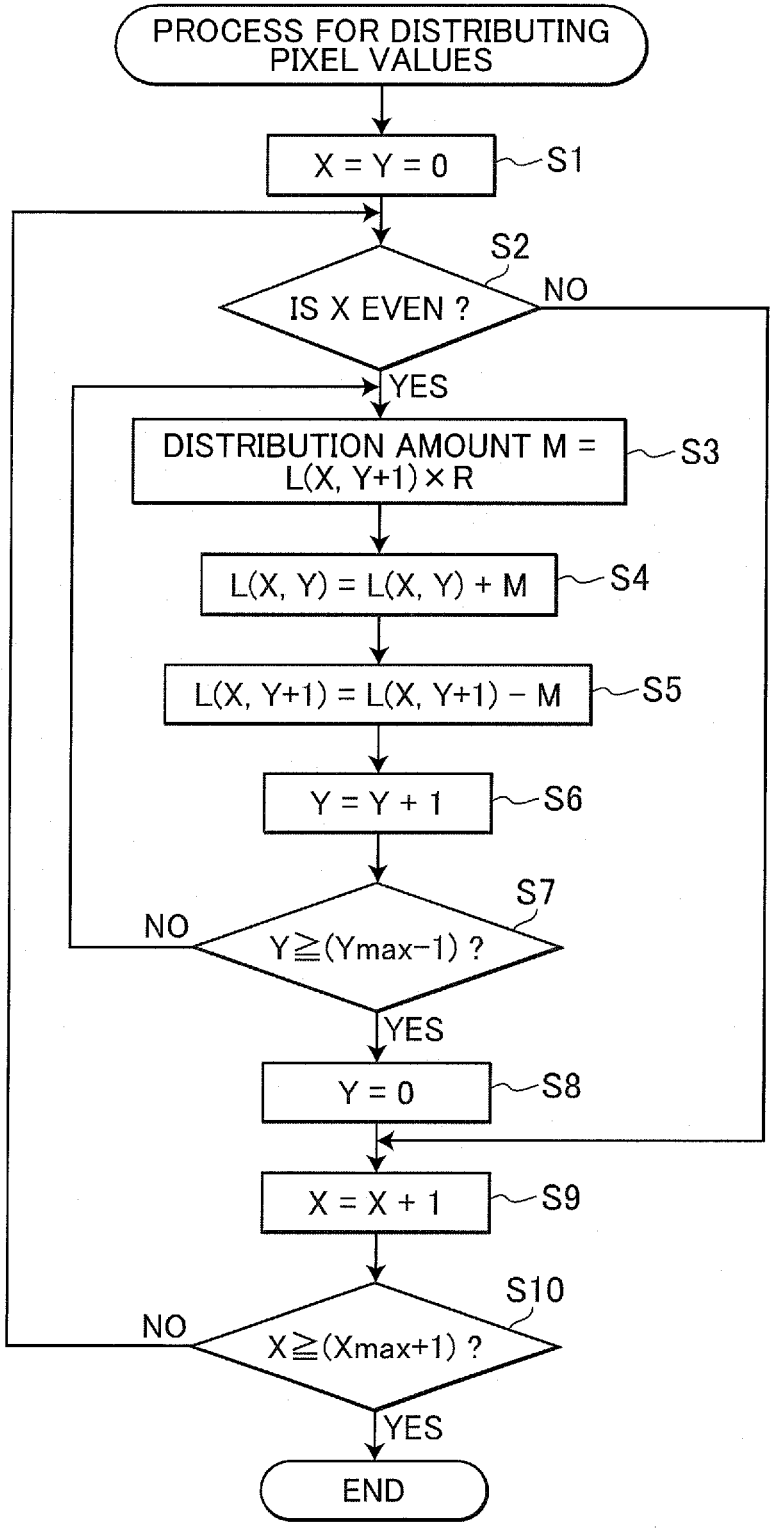
FIG. 13 is a flowchart illustrating steps in a pixel value distribution process.

FIG. 13 is a flowchart illustrating steps in a pixel value distribution process. The CPU 44 executes this process based on the pixel value distribution program 45*c*. In S1 of the process the CPU 44 initializes the coordinates (X, Y). In S2 the CPU 44 determines whether the X is even. If X is odd (S2: NO), then in S9 the CPU 44 increments X by 1.

However, if X is even (S2: YES), in S3 the CPU 44 calculates a distribution amount M. The distribution amount M is calculated by multiplying the distribution ratio R by the pixel value L (X, Y+1) of the pixel adjacent to a target pixel in the +Y direction. After calculating the distribution amount M, in S4 the CPU 44 calculates the pixel value L (X, Y) of the target pixel. The value L (X, Y) of the target pixel is calculated by adding the distribution amount M to the value L (X, Y) of the target pixel. In S5 the CPU 44 decrements the pixel value L (X, Y+1) of the pixel adjacent to the target pixel in the +Y direction by the distribution amount M.

After completing the process for the current target pixel, in S6 the CPU 44 increments Y by 1 in order to process the next target pixel. In S7 the CPU 44 determines whether the Y value of the next target pixel has reached the bottom (Ymax−1). If so (S7: YES), then in S8 the CPU 44 initializes Y (Y=0). If not (S7: NO), then the CPU 44 repeats the process from S3.

In S9 the CPU 44 increments X by 1 in order to repeat the process described above on the next column of pixels. In S10 the CPU 44 determines whether the new value of X has reached the right end (Xmax+1). If so (S10: YES), the process ends. If not (S10: NO), then the CPU 44 repeats the process from S2.

Figure 14A:
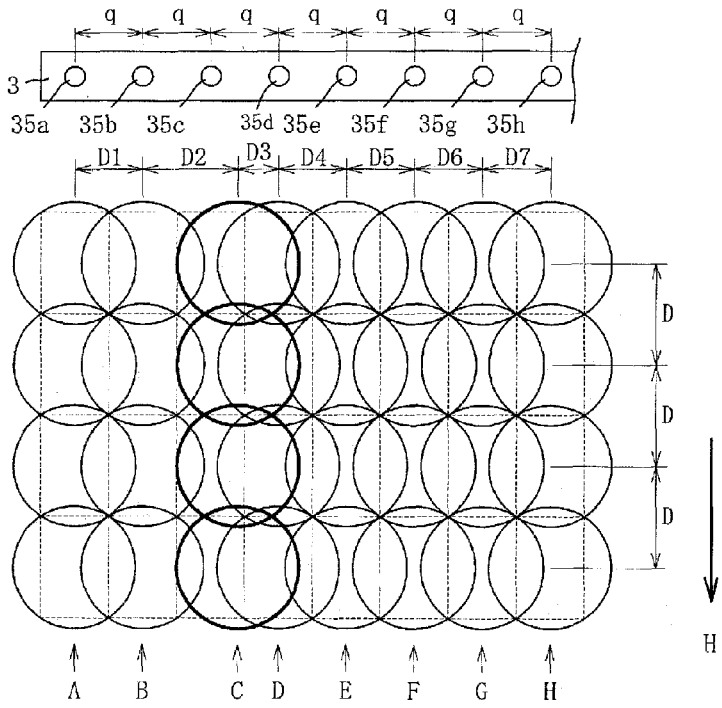
FIG. 14(*a*) is related to a seventh embodiment and shows the relationship between the nozzles and the dots formed by ink droplets ejected from the nozzles.
Figure 14B:
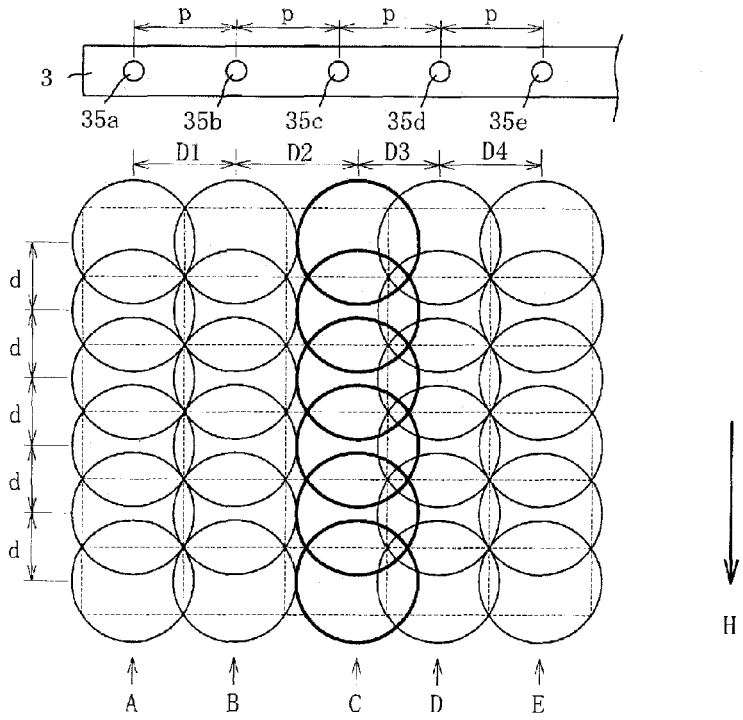

Next, a seventh embodiment of the present invention will be described with reference to FIG. 14(*a*), wherein the pitch of the nozzles 35*a*-35*e* is set to a smaller pitch q than the conventional pitch p. FIG. 14(*a*) shows the relationship between the nozzle 35*a* and the like and the dots formed by ink droplets ejected from the nozzle 35*a* and the like.

In the seventh embodiment, dots are formed in the main scanning direction at a smaller pitch than that of dots formed in the subscanning direction H by setting the pitch of the nozzle 35*a* and the like smaller than the conventional pitch in FIG. 1 while using the same ejection timing in the subscanning direction as the conventional timing in FIG. 1. This method produces a larger overlapped area of neighboring dots formed in the main scanning direction than the overlapping area of neighboring dots formed in the subscanning direction H.

As shown in FIG. 14(*a*), the columns of dots B and C remain overlapped in the seventh embodiment, even if the nozzle 35*c* ejects ink droplets with a bias toward the nozzle 35*d* so that the column of dots C is formed closer toward the column of dots D. Hence, the seventh embodiment keeps the gap between the columns of dots B and C smaller than that shown in FIG. 1(*b*), making the gap less noticeable in order to form images of high quality.

However, reducing the pitch between nozzles in this way makes the overlapped portion of dots in the main scanning direction greater than that in the subscanning direction. Hence, the size of the original print data in the main scanning direction is reduced relative to that in the subscanning direction H, thereby distorting the image.

Therefore, the PC 1 in the seventh embodiment outputs instructions to the printer 1A to form more dots in the subscanning direction based on the reduction in pitch of the nozzle 35*a* and the like. By doing so, the ratio of the image size in the main scanning direction and subscanning direction H approaches the ratio of the image size corresponding to the print data, thereby reducing distortion in the image.

For example, using the pixel layout of four rows and five columns shown in FIG. 10(*a*) as the original print data, the pixel layout conversion program 45*b* converts this pixel layout to a layout having four rows and eight columns by adding an additional four columns of pixels based on the reduction in size produced by reducing the pitch of the nozzle 35*a* and the like and outputs instructions to the printer 1A to eject ink droplets for each pixel in the converted pixel layout. This method brings the size ratio of the image in the main scanning direction and subscanning direction H near the size ratio in the original print data, thereby reducing distortion in the image.

Next, a control process according to an eighth embodiment executed by the PC 1 will be described with reference to FIG. 14(*b*). FIG. 14(*b*) shows the relationship between the nozzle 35*a* and the like and dots formed by ink droplets ejected from the nozzle 35*a* and the like.

In the eighth embodiment, the nozzle pitch is set identical to the conventional pitch in FIG. 1, but the ejection timing for the subscanning direction H is set shorter than the conventional timing in FIG. 1. As a result, the overlapping area of dots formed in the subscanning direction H is greater than that for dots formed in the main scanning direction.

As shown in FIG. 14(*b*), the columns of dots B and C remain overlapped in the eighth embodiment, even if the nozzle 35*c* ejects ink droplets with a bias toward the nozzle 35*d* so that the column of dots C is formed closer to the column of dots D. Hence, the eighth embodiment keeps the gap between the columns of dots B and C smaller than that shown in FIG. 1(*b*), making the gap less noticeable in order to form images of high quality.

However, by reducing the ejection timing in the subscanning direction H, the overlapping area of dots formed in the subscanning direction is greater than that in the main scanning direction. Therefore, the size of the original print data in the subscanning direction H is reduced, producing distortion in the image.

Accordingly, the PC 1 in the eighth embodiment outputs instructions to the printer 1A for forming more dots in the subscanning direction H based on the reduced ejection timing for the subscanning direction H. By doing so, the size ratio of the image in the subscanning direction H and main scanning direction approaches the ratio corresponding to the print data, thereby reducing distortion in the image.

For example, when using the pixel layout of four rows and five columns shown in FIG. 10(*a*) as the original print data, the pixel layout conversion program 45*b* converts this layout to a pixel layout of six rows and five columns by adding an additional two rows of pixels based on the reduced ejection timing for the subscanning direction H and outputs instructions to the printer 1A for ejecting ink droplets for each pixel in the converted pixel layout. As a result, the size ratio of the image in the main scanning direction and subscanning direction H approaches the size ratio in the original print data, thereby suppressing distortion in the image.

Next, a control process according to a ninth embodiment executed by the PC 1 will be described with reference to FIG. 15. The ninth embodiment is a combination of the sixth embodiment described in FIG. 9 and the seventh embodiment described in FIG. 14(*a*) for controlling the printer 1A.

Figure 15A:
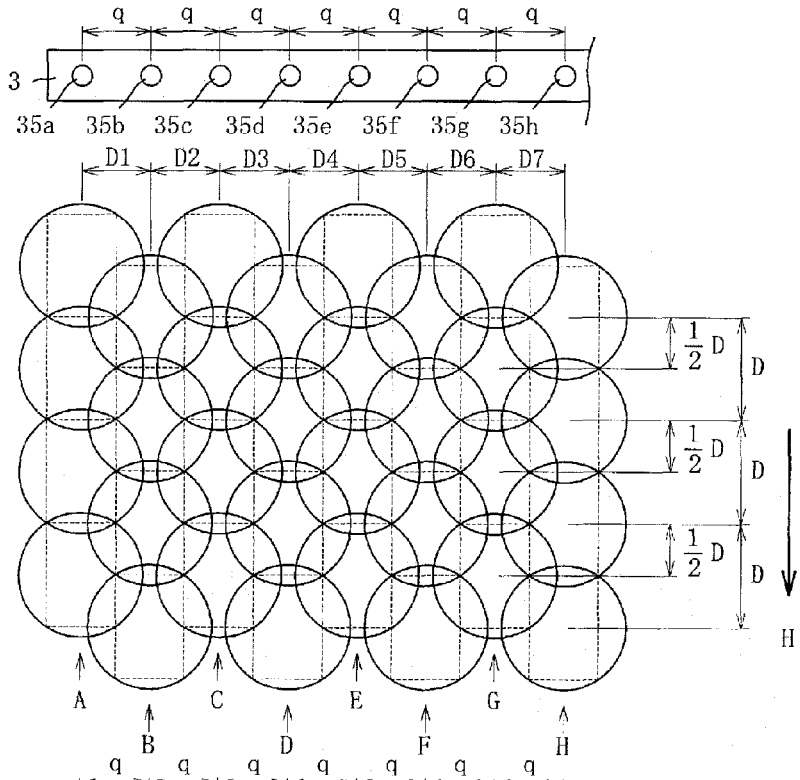
FIG. 15 is related to a ninth embodiment, wherein FIG. 15(*a*) shows the relationship between the nozzles and dots formed by ink droplets ejected from the nozzles.
Figure 15B:
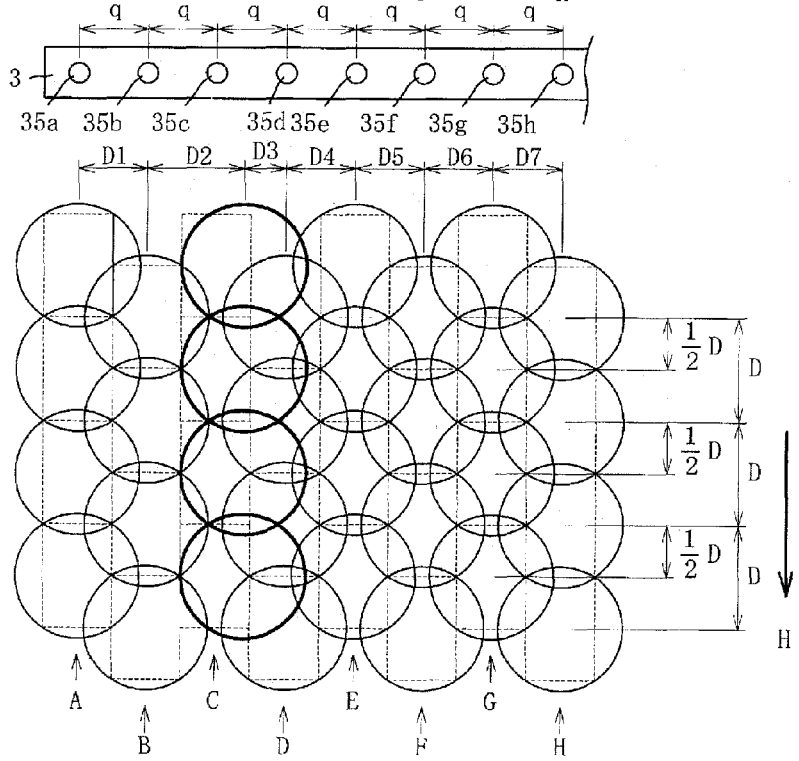

FIG. 15(*a*) shows the relationship between the nozzle 35*a* and the like and dots formed by ink droplets ejected from the nozzle 35*a* and the like. FIG. 15(*b*) shows the case of forming dots as shown in FIG. 15(*a*) when for some reason ink droplets ejected from the nozzle 35*c* land with a bias toward the nozzle 35*d*.

Specifically, as in the sixth embodiment described above, the ninth embodiment shifts every other column of dots in the subscanning direction H by about half a pitch D of the dots aligned in the subscanning direction H (½*D). Further, as described in the seventh embodiment in FIG. 14(*a*) the ninth embodiment sets a smaller pitch q than the conventional pitch in FIG. 1 and sets the ejection timing for the subscanning direction H the same as the ejection timing in FIG. 1, and further outputs instructions to the printer 1A to form more dots in the main scanning direction based on the reduction in pitch of the nozzle 35*a* and the like.

Since the general control method can be achieved by combining the sixth and seventh embodiments described above, a description of this method has been omitted.

This control can reduce the gap produced between the columns of dots B and C more than the conventional method shown in FIG. 1(*b*), even when ink droplets expected to land as shown in FIG. 15(*a*) form a column of dots C with a bias toward the column of dots D, as shown in FIG. 15(*b*), because the nozzle 35*c* ejects ink droplets with a bias toward the nozzle 35*d* for some reason.

Figure 16A:
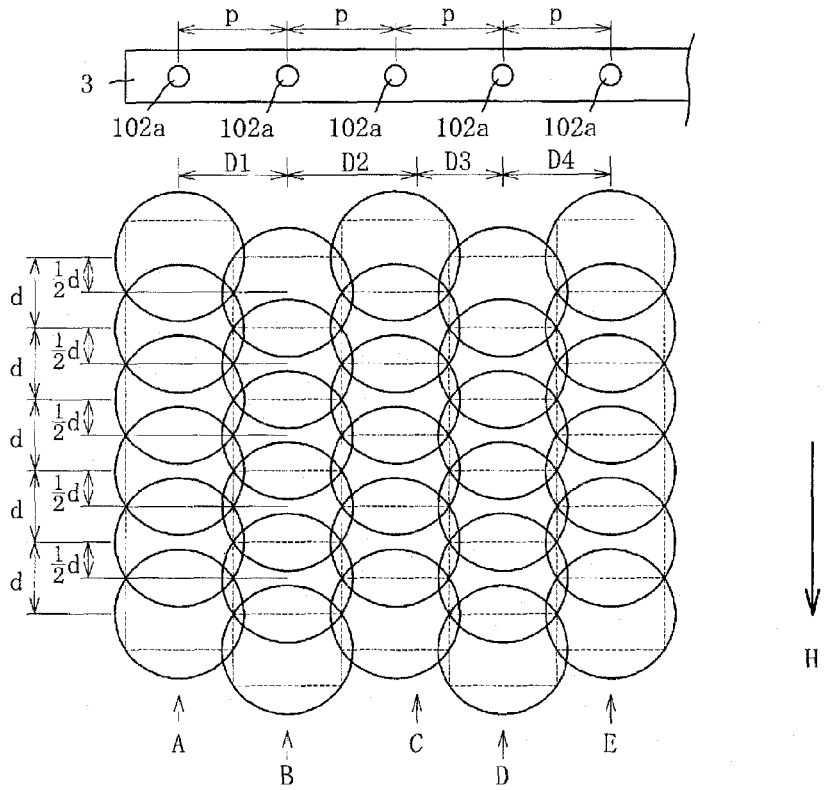
FIG. 16 is related to a tenth embodiment, wherein FIG. 16(*a*) shows the relationship between the nozzles and dots formed by ink droplets ejected from the nozzles.
Figure 16B:
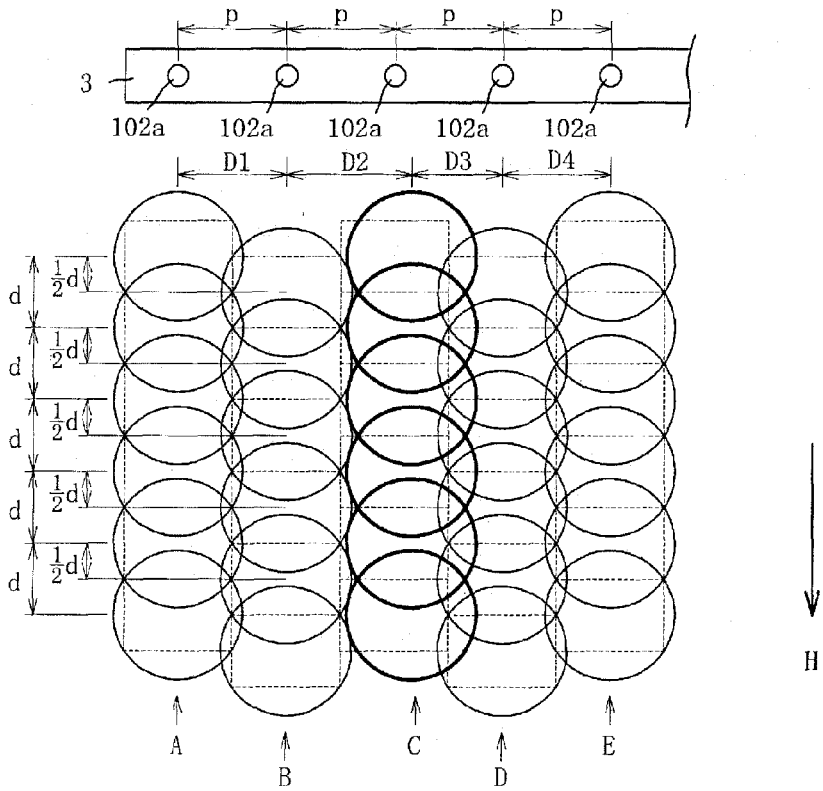

Next, a control process according to a tenth embodiment executed by the PC 1 will be described with reference to FIG. 16. As shown in FIG. 16(*a*), the tenth embodiment is a combination of the sixth embodiment described in FIG. 9 and the eighth embodiment described in FIG. 14(*b*) for controlling the printer 1A.

FIG. 16(*a*) shows the relationship between the nozzle 35*a* and the like and dots formed by ink droplets ejected from the nozzle 35*a* and the like. FIG. 16(*b*) shows the state of dots formed according to the design in FIG. 16(*a*) when some factor causes ink droplets ejected from the nozzle 35*c* to land with a bias toward the nozzle 35*d*.

Specifically, as described in the second embodiment, the tenth embodiment shifts every other column of dots in the subscanning direction H by about half the pitch D of dots arranged in the subscanning direction H (½*D). Further, as described in the seventh embodiment shown in FIG. 14(*b*), the tenth embodiment sets the nozzle pitch p the same as the conventional pitch in FIG. 1, sets the ejection timing for the subscanning direction H shorter than the conventional timing in FIG. 1, and also outputs instructions to the printer 1A to form more dots in the subscanning direction H based on the reduced ejection timing in the subscanning direction H. Since the control method is achieved by combining the sixth and eighth embodiments described above, a detailed description of this method has been omitted.

This control method can reduce the gap produced between the columns of dots B and C more than the conventional method shown in FIG. 1(*b*) if some factor causes the nozzle 35*c* to eject ink droplets with a bias toward the nozzle 35*d* so that the column of dots C to be formed as shown in FIG. 16(*a*) is formed with a bias toward the column of dots D, as shown in FIG. 16(*b*).

Figure 17A:
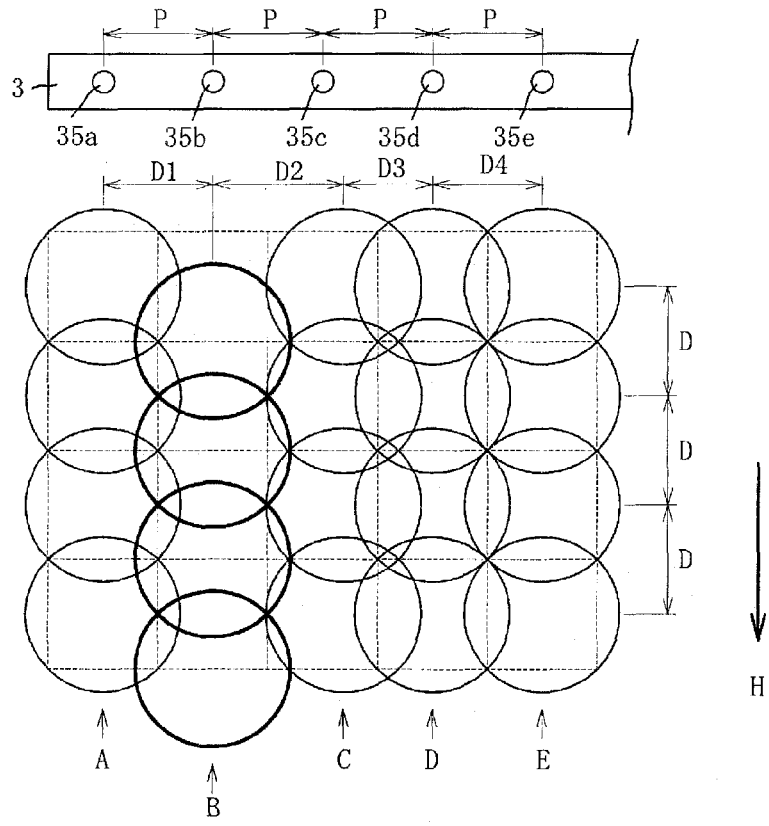
FIG. 17 is related to an eleventh embodiment and shows the relationship between the nozzles and dots formed by ink droplets ejected from the nozzles.
Figure 17B:
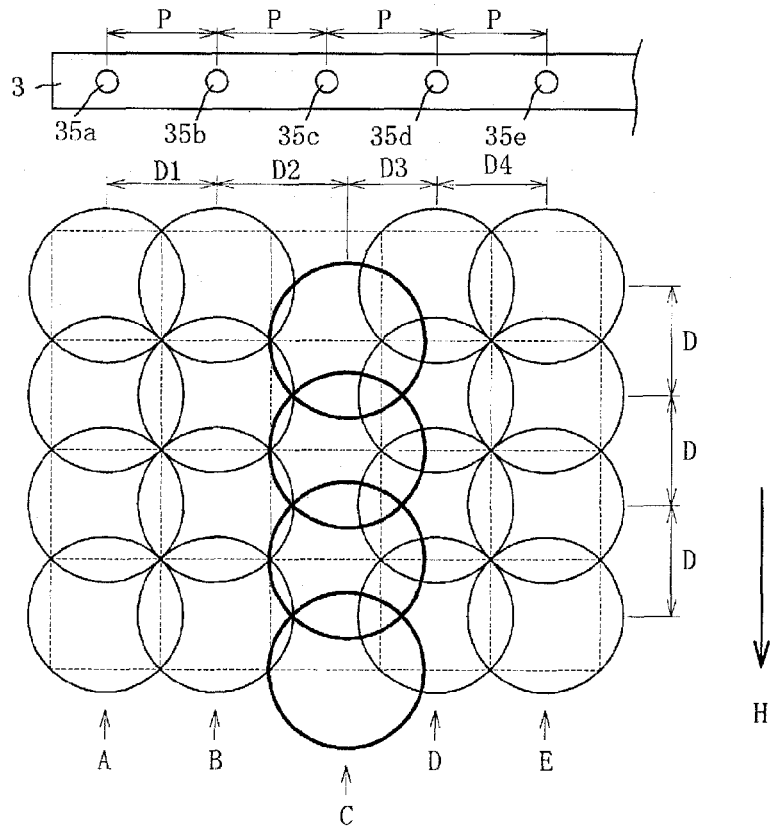

Next, a control process according to an eleventh embodiment executed by the PC 1 will be described with reference to FIG. 17. FIGS. 17(*a*) and 17(*b*) show the relationship between the nozzle 35*a* and the like and dots formed by ink droplets ejected from the nozzle 35*a* and the like.

The control process in the sixth embodiment described above shifts every other column of dots in the subscanning direction H and is capable of compensating for nozzles that eject ink droplets in a slanted direction relative to the printing medium, even without identifying those nozzles. However, the control process in the eleventh embodiment compensates for nozzles that eject ink droplets in a slanted direction to the printing medium by first identifying those nozzles.

In the eleventh embodiment, a CCD line scanner, for example, is used to read the gaps produced between each column of dots based on the density differential. This data is used to determine when the pitch of neighboring dots in the main scanning direction is greater than the prescribed pitch and to identify the two nozzles forming dots at this position.

For example, if the nozzle 35*c* ejects ink droplets with a bias toward the nozzle 35*d* so that the pitch D2 between the columns of dots B and C is greater than the pitch of other neighboring columns, then in the preferred embodiment the nozzle 35*b* and nozzle 35*c* are identified as the two nozzles.

One of the two nozzles 35*b* and 35*c* is then controlled so that only dots formed by ink droplets ejected from this nozzle are shifted in the subscanning direction H.

FIG. 17(*a*) shows the dot pattern when the column of dots B corresponding to the pixel layout conversion program 45*b* is shifted in the subscanning direction H. Thus, the method of the present embodiment can reduce the gap produced between the columns of dots B and C more than the conventional method shown in FIG. 1(*b*) when the nozzle 35*c* ejects ink droplets with a bias toward the nozzle 35*d* so that the column of dots C is formed closer to the column of dots D.

FIG. 17(*b*) shows a dot pattern formed when the column of dots C corresponding to the nozzle 35*c* is shifted in the subscanning direction H. As in the method shown in FIG. 17(*a*), this method also reduces the gap produced between the columns of dots B and C more than the conventional method shown in FIG. 1(*b*) when the nozzle 35*c* ejects ink droplets with a bias toward the nozzle 35*d* so that the column of dots C is formed closer to the column of dots D.

By performing suitable control after first identifying nozzles that eject ink droplets along a slanted trajectory relative to the printing medium in this way, the method of the present embodiment can minimize the number of dot columns shifted in the subscanning direction H to suppress distortion in the image, rather than shifting every other column of dots as in the control process of the sixth embodiment.

The eleventh embodiment described above addresses the case of ink droplets for forming the column of dots C landing at positions deviating in the main scanning direction. However, if ink droplets impact the printing medium at positions deviating in the subscanning direction H, it is possible to shift a row of dots in the main scanning direction.

Figure 18:
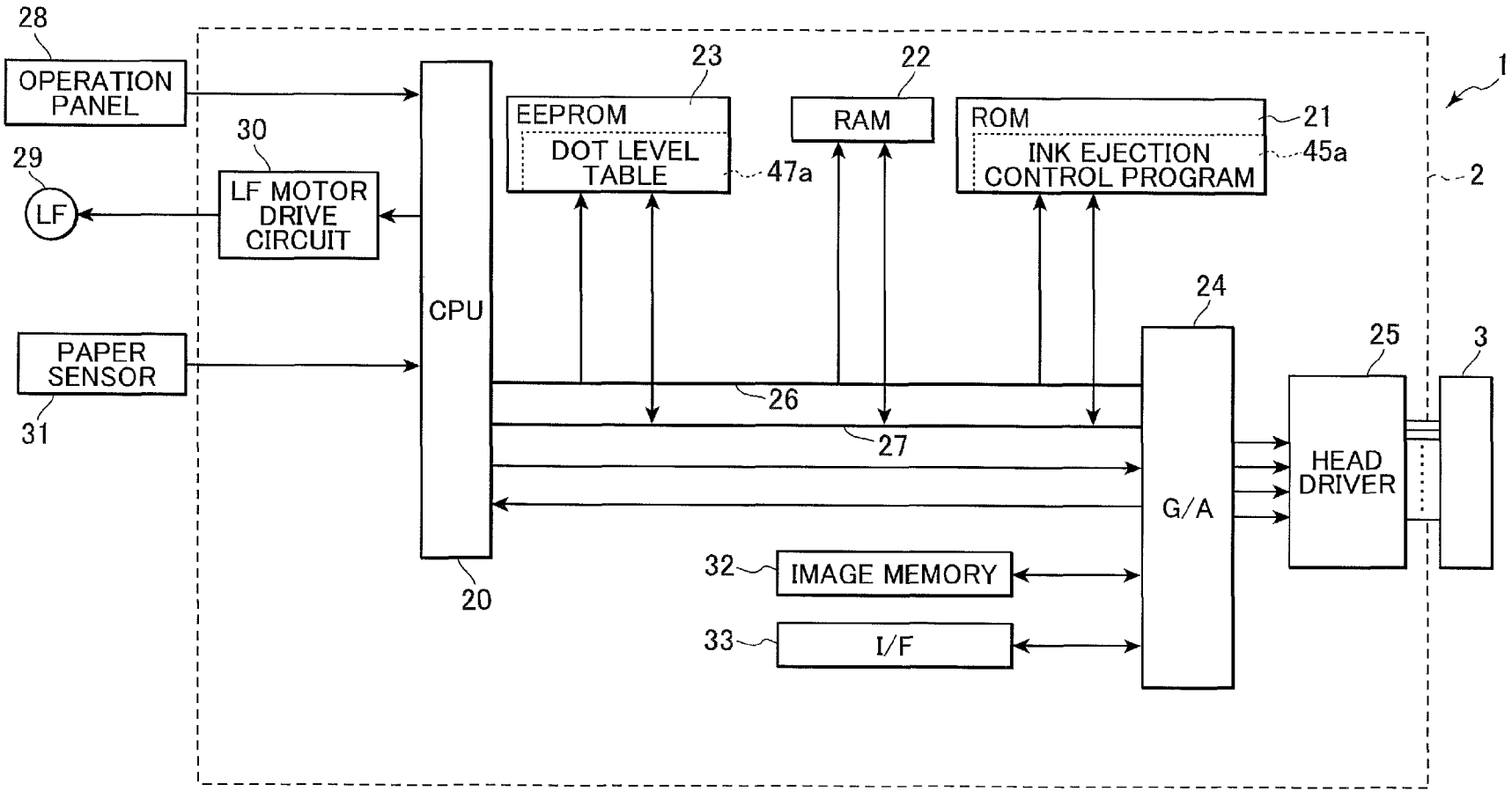
FIG. 18 is a block diagram showing the general structure of an electric circuit in the inkjet printer.

Next, an inkjet printer 2A serving as the inkjet recording device of the present invention will be described with reference to FIG. 18. FIG. 18 is a block diagram showing the general structure of an electric circuit in the inkjet printer 2A.

The inkjet printer 2A (hereinafter abbreviated as "printer 2A") has a similar structure to the printer 1A described above, but stores the ink ejection control program 45*a* in the ROM 21 and the dot level table 47*a* in the EEPROM 23.

In this way, the ink ejection control program 45*a* and dot level table 47*a* installed on the PC 1 in the description above may be installed directly on the printer 2A so that the processes performed on the PC 1 may be executed in the printer 2A. As with the printer 1A described above, the printer 2A having this configuration can form images of high quality.

While the invention has been described in detail with reference to specific embodiments thereof, it would be apparent to those skilled in the art that many modifications and variations may be made therein without departing from the spirit of the invention, the scope of which is defined by the attached claims.

In the preferred embodiments described above, the size of dots formed for each nozzle are changed according to a method of changing the voltage applied to the drive elements driving each nozzle. However, the present invention is not limited to this method.

For example, a plurality of ink droplets having a prescribed volume can be combined in flight or on the printing medium, effectively producing a larger surface area of a dot formed by the combined ink droplets. Further, in place of the printer 1A that ejects ink from the nozzles with drive elements, it is possible to use a printer having a heat source for each nozzle, wherein ink is ejected from each nozzle according to heat produced by the heat sources. In such a case, the size of dots formed with each nozzle can be controlled by controlling the amount of heat produced in each heat source.

Further, while the preferred embodiments described above address the case of detecting gaps between dots with a CCD scanner provided separately from the printer 1A, a device for detecting such gaps may also be incorporated in the printer 1A. This configuration therefore does not require a separate detecting device, eliminating the stress of having to detect gaps using a separate detecting device.

Further, the preferred embodiments described above address the case in which the trajectory of ink droplets deviates from the direction perpendicular to the surface of the printing medium in the direction of the nozzle alignment. However, if the trajectory of the ink droplets deviates in the conveying direction of the printing medium, the gap formed between dots can be reduced by controlling the timing at which ink droplets are ejected from the nozzle.

Further, in the preferred embodiments described above, the dot levels stored in the dot level table 47*a* are parameters based on the level "0" and indicate how many levels larger or smaller to form the size of dots relative to the level "0". However, the parameters stored as dot levels are not limited to these values. For example, voltage values to be applied to each nozzle may be directly stored as the dot level. This configuration has the effect of increasing the process speed since it is not necessary to check the correlation with a preset parameter.

Further, if a small gap is produced between the rows of dots D and E, for example, when reducing the size of dots produced by the nozzle 35*d*, as in the first embodiment shown in FIG. 4, it is possible to adjust the dot level for the nozzle 35*e* from "0" to "+1" so that the nozzle 35*e* produces dots of a size larger than the size specified in the print data. In this way, the row of dots E can be used to reduce the small gap produced between the rows of dots D and E in order to form images of a high quality.

While the ninth and eleventh embodiments described above address the case of shifting every other column or a specific column of dots in the subscanning direction H, it is also possible to output instructions for nozzles ejecting dots in the shifted columns in order to eject an additional ink droplet for one pixel on the end of the column opposite the shifted direction, as described in the sixth embodiment. This suppresses distortion in the image by adjusting the pixel layout.

In the preferred embodiments described above, the PC 1 is used as the print controlling means by connecting the PC 1 to the printer 1A via the interface 48. However, the control performed by the PC 1 may also be implemented in the printer 1A by installing the various programs stored in the ROM 45 of the PC 1 on the printer 1A. In this case, printing can be controlled by the PC 1 when print data is received from a PC not provided with such programs.

Further, the preferred embodiments described above address the case in which the trajectory of ink droplets deviates from the direction perpendicular to the surface of the printing medium in the direction of the nozzle alignment (main scanning direction). However, if the trajectory of the ink droplets deviates in the conveying direction of the printing medium (subscanning direction H), the gap formed between dots can be reduced by controlling the timing at which ink droplets are ejected from the nozzle.

Further, while the methods described in the sixth, eighth, and ninth embodiments involve shifting every other column of dots in the subscanning direction H, it is also possible to shift every second or third column in the subscanning direction H or to shift every other group of columns in the subscanning direction H, where one group includes a plurality of columns.

The invention claimed is:

1. An inkjet recording device, comprising:

nozzles arranged in a first direction to eject ink droplets within a printing area of a printing medium, and a line head in which the nozzles are formed that moves relative to the printing medium in a second direction orthogonal to the first direction for forming an image on the printing medium, wherein the nozzles are arranged at a pitch in the first direction smaller than a pitch in the second direction of dots formed by ink droplets ejected from the nozzles impacting the printing medium, wherein an overlapped area of neighboring dots in the first direction is larger than an overlapped area of neighboring dots in the second direction.

2. The inkjet recording device according to claim 1, further comprising an outputting unit configured to outputs instructions to eject ink droplets from the nozzles toward the printing medium so as to impact the printing medium at prescribed positions for forming dots corresponding to print data;

the outputting unit configured to output instructions to form more dots in the first direction than the number indicated in the print data based on the pitch of nozzles in the first direction that is smaller than the pitch of neighboring dots in the second direction.

3. The inkjet recording device according to claim 1, further comprising a controller configured to control the line head, by outputting instructions to the line head to eject ink droplets from nozzles toward the printing medium so that the ink droplets impacting the printing medium form dots at prescribed positions corresponding to the print data, the controller comprising an outputting unit configured to output instructions to the line head so that every nth column among columns of dots extending in the second direction is shifted in the second direction.

4. The inkjet recording device according to claim 1, further comprising a controller configured to control the line head, by outputting instructions to the line head to eject ink droplets from the nozzles toward the printing medium so that the ink droplets impacting the printing medium form dots at prescribed positions based on the print data, the controller comprising an outputting unit configured to output instructions to the line head so that neighboring dots in the second direction orthogonal to the first direction have a smaller pitch than neighboring dots in the first direction throughout a printing area on the printing medium.

5. The inkjet recording device according to claim 1, further comprising a controller configured to control the line head, by outputting instructions to the line head to eject ink droplets from the nozzles toward the printing medium so that the ejected ink droplets form dots on the printing medium at prescribed positions specified in print data, the controller comprising an outputting unit configured to output instructions to the line head so that dots formed by ink droplets ejected from a first nozzle are shifted in the second direction, the first nozzle being at least one of two nozzles ejecting ink droplets that impact positions to form neighboring dots in the first direction with a pitch greater than a prescribed pitch.

6. The inkjet recording device according to claim 1, comprising a storage unit that stores a control program configured to control the line head, by outputting instructions to the line head to eject ink droplets from the nozzles toward the printing medium so that the ink droplets impacting the printing medium form dots at prescribed positions corresponding to the print data, the control program comprising an outputting step for outputting instructions to the line head so that every nth column among columns of dots extending in the second direction is shifted in the second direction.

7. The inkjet recording device according to claim 1, further comprising a storage unit that stores a control program configured to control the line head, by outputting instructions to the line head to eject ink droplets from the nozzles toward the printing medium so that the ink droplets impacting the printing medium form dots at prescribed positions based on the print data, the control program comprising an outputting step for outputting instructions to the line head so that neighboring dots in the second direction orthogonal to the first direction have a smaller pitch than a pitch of neighboring dots in the first direction throughout a printing area on the printing medium.

8. The inkjet recording device according to claim 1, comprising a storage unit that stores a control program configured to control the line head, by outputting instructions to the line head to eject ink droplets from the nozzles toward the printing medium so that the ejected ink droplets form dots on the printing medium at prescribed positions specified in print data, the control program comprising an outputting step for outputting instructions to the line head so that dots formed by ink droplets ejected from a first nozzle are shifted in the second direction, the first nozzle being at least one of two nozzles ejecting ink droplets that impact positions to form neighboring dots in the first direction with a pitch greater than a prescribed pitch.

* * * * *

UNITED STATES PATENT AND TRADEMARK OFFICE

CERTIFICATE OF CORRECTION

PATENT NO. : 8,500,231 B2
APPLICATION NO. : 13/353456
DATED : August 6, 2013
INVENTOR(S) : Masahiro Nishihara It is certified that error appears in the above-identified patent and that said Letters Patent is hereby corrected as shown below:

In the Claims

In Column 36, Claim 2, Line 31:
Please replace “outputs” with --output--.

Signed and Sealed this
Twenty-fourth Day of June, 2014

Michelle K. Lee

Michelle K. Lee
*Deputy Director of the United States Patent and Trademark Office*